US007006113B2

(12) United States Patent
Yamamoto et al.

(10) Patent No.: US 7,006,113 B2
(45) Date of Patent: Feb. 28, 2006

(54) DISPLAY APPARATUS WITH PIXELS ARRANGED IN MATRIX

(75) Inventors: Tsunenori Yamamoto, Hitachi (JP); Tatsuki Inuzuka, Mito (JP); Ikuo Hiyama, Hitachinaka (JP); Shinichi Komura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 741 days.

(21) Appl. No.: 09/933,799

(22) Filed: Aug. 22, 2001

(65) Prior Publication Data

US 2002/0118158 A1 Aug. 29, 2002

(30) Foreign Application Priority Data

Feb. 28, 2001 (JP) ..... 2001-054352

(51) Int. Cl.
*G09G 5/00* (2006.01)

(52) U.S. Cl. ..... 345/690; 345/89

(58) Field of Classification Search ..... 345/690–699, 345/204–213, 596, 660, 784, 87–100; 348/798
See application file for complete search history.

(56) References Cited

U.S. PATENT DOCUMENTS 3,937,878 A * 2/1976 Judice ..... 348/798
4,751,507 A * 6/1988 Hama et al. ..... 345/784
5,644,340 A * 7/1997 Harney ..... 345/212
6,034,663 A * 3/2000 Killebrew et al. ..... 345/596
6,043,802 A * 3/2000 Gormish ..... 345/596
6,072,457 A * 6/2000 Hashimoto et al. ..... 345/100
6,417,866 B1 * 7/2002 Man et al. ..... 345/660
6,750,875 B1 * 6/2004 Keely et al. ..... 345/613

FOREIGN PATENT DOCUMENTS

| | | |
|---|---|---|
| JP | A-11-75144 | 3/1999 |
| JP | 11-202299 | 7/1999 |
| KR | 1999-018054 | 3/1999 |

OTHER PUBLICATIONS

SID 00 DIGEST pp 38-41.

* cited by examiner

*Primary Examiner*—Amr A. Awad
(74) *Attorney, Agent, or Firm*—Antonelli, Terry, Stout & Kraus, LLP.

(57) ABSTRACT

A display apparatus includes pixels arranged in matrix; a pixel electrode disposed inside each of the pixels; a display device disposed inside each of the pixels, for executing display in accordance with a voltage of the pixel electrode; a scanning line driving circuit; an identification signal line driving circuit; a storage unit for storing the identification signal supplied from the identification signal line in the pixel; a gray scale voltage line driving circuit; a selection unit for selecting the gray scale voltage supplied to the gray scale voltage lines based on the identification signal stored in the storage unit; a switching device for applying the selected gray scale voltage to the pixel electrode; and a gray scale write line driving circuit for supplying a gray scale write signal to a gray scale write line for controlling the switching device.

19 Claims, 15 Drawing Sheets

STILL IMAGE 1-0 ≠ 2-0
1-1 ≠ 2-1

4×4 PIXEL BLOCK IS DISPLAYED BY 4 GRAY SCALES.
RE-WRITE BY 2 FRAMES

MOTION IMAGE 1-0 ≒ 2-0
1-1 ≒ 2-1

4×4 PIXEL BLOCK IS DISPLAYED BY 2 GRAY SCALES.
RE-WRITE BY 1 FRAME

DISPLAY APPARATUS WITH PIXELS ARRANGED IN MATRIX

BACKGROUND OF THE INVENTION

1. Field of the Invention

This invention relates to a display apparatus. More particularly, the present invention relates to a ultra-high resolution display apparatus having a high driving frequency.

2. Description of the Related Art

CRT (Cathode Ray Tube) display apparatuses have long been predominant as display apparatuses but LCD (Liquid Crystal Display) has gained an increasing application in recent years. Further, PDP (Plasma Display Panel) and FED (Field Emission Display) have now been put on the market.

All of these current display apparatuses have employed a display system that scans pixels and lines in a transverse direction and in a longitudinal direction to display one frame (one screen) such as a line scanning system and a pixel scanning system. This is partly because display data for one screen is transferred by the dot sequential system.

Initially, explanation will be given on a liquid crystal display apparatus of a TFT (Thin Film Transistor) active matrix driving system according to the prior art.

The line scanning system is employed for driving the TFT active matrix liquid crystal display apparatus. Display data for one row transferred by the pixel sequential system is stored in a signal driver and is outputted to a signal line in synchronism with a scanning pulse applied to a scanning line. In each scanning line, a scanning pulse is applied from above to below of a panel once per one frame time. As a display signal is written to pixels connected to each scanning line, one screen is constituted.

One frame time is generally about 1/60 sec. In a liquid crystal display apparatus having a pixel construction of 1,024×768 dots, therefore, 768 gate wires are scanned within one frame. When a non-display period is taken into consideration, the time width of one scanning pulse is about 20 μsec.

A gate electrode voltage of a TFT rises in the pixel to which this scanning pulse is applied and the TFT is turned ON. At this time, a liquid crystal driving voltage applied to the signal line is applied to a display electrode through the source and the drain of the TFT. A pixel capacitance as the sum of a liquid crystal capacitance formed between the display electrode and an opposing electrode formed over an opposing substrate and a storage capacitance arranged on the pixel is charged within the 20 μsec time described above.

On the other hand, a display apparatus using the CRT does not employ the line sequential system but employs the pixel sequential system that executes scanning both longitudinally and transversely by use of the transferred display data as beam spots. In this case, too, one frame time is about 1/60 sec. In a pixel construction of 1,024×768 dots, the time required for depicting one transverse line is about 20 μsec. PDP, too, employs fundamentally the line sequential driving system.

Higher computerization in recent years has required the increase of display capacity from such display apparatuses. The requirements include, for example, the increase of a display information quantity by achieving high resolution images, the improvement of still image reproducibility by achieving higher density and the improvement of motion picture quality by attaining a higher driving frequency.

The increase of the quantity of information to be displayed calls for the increase of the band of a transmission system from an image output source to the display apparatus. On the side of the display apparatus that receives the display data, too, the increase of the processing capacity is necessary for a processing circuit that converts the reception data to a form suitable for the display apparatus. Further, the improvement of the processing capacity is necessary for a driving method in the display apparatus. According to the conventional TFT active matrix driving system, for example, the time width of the scanning pulse becomes smaller with the increase of high resolution pixels to be displayed in order to conduct such an operation. In other words, the pixel capacitance must be charge within a shorter time. To cope with high-speed motion images, one frame time must be further reduced. In this case, too, the time width of the scanning pulse becomes smaller. The liquid crystal driving voltage is supplied from a driving circuit disposed at one of the end portions through a signal electrode line. In this case, a delay develops in the liquid crystal driving voltage supplied to the pixel capacitance due to a wiring delay of the signal electrode line. To conduct normal display, the pulse time width must have a sufficient time margin to cope with this delay time. Nonetheless, the conventional line sequential driving system cannot sufficiently secure this time width when high precision or high-speed motion image display is conducted, and sometimes fails to normally display the images.

As described above, the following three principal problems must be solved to increase the quantity of information to be displayed, that is, (1) the improvement of the substantial transfer capacity of the display data, (2) the increase of the processing capacity of the data processing circuit of the display apparatus and (3) the increase of the display capacity of the display apparatus.

(1) To improve the substantial transfer capacity of the display data, a PV link system for transferring only the data of the image region that exhibits any change in comparison with one previous frame, and a transfer system that compresses the images to such an extent that compression is not noticeable to human eyes, have been proposed as described in SID' 00DIGEST p. 39.

As to (3) the increase of the display capacity of the display apparatus, JP-A-11-75144, for example, describes a display method capable of rewriting images at a high speed to cope with the increase of a refresh rate. According to this method, two memories and means for driving a pixel in accordance with the memory content are provided to each pixel of an optical spatial modulation device, data is written in advance into the first memory inside the pixel for all the pixels that constitute the image to be displayed, the data is then transferred altogether from the first memory to the second memory, the driving means controls at a high speed ON/OFF of light in each pixel in accordance with the data of the second memory and images of multiple gray scales are thus displayed by pulse width modulation (PWM).

When the conventional display apparatus receives the image data by the PV link system or the image compression system described above, however, the processing capacity of the processing circuit must be greatly increased as the problem (2) because the received data cannot be displayed as such on the display apparatus. Since no measure is taken to cope with the problem (3), it is not clear whether or not the image can be normally displayed.

When the method disclosed in JP-A-11-75144 described above is used for the problem (3), the transferred display data cannot be displayed as such because this method uses pulse width modulation (PWM) as the multi-gray scale display method. This means that the processing capacity must be drastically increased as the problem (2), but the drastic increase of the processing circuit in turn results in a drastic increase of the cost of production.

SUMMARY OF THE INVENTION

It is an object of the present invention to provide a display apparatus that (1) can receive display data whose substantial transfer capacity is improved, such as data of a PV link system or an image compression system, (2) does not need to drastically improve the processing capacity of a data processing circuit, and (3) can normally display a greater quantity of information.

According to one aspect of the present invention for accomplishing the object described above, there is provided a display apparatus for executing display by independently applying a signal to each pixel of a group of pixels arranged in matrix, by use of lead wires arranged in row and column directions, comprising display control means for displaying a compressed image signal without developing it to a bit map in which each pixel has gray scale information.

According to another aspect of the present invention, there is provided a display apparatus having the construction described above, comprising a display control unit for expanding a compressed image signal to gray scale information for each pixel, disposed inside each pixel.

According to still another aspect of the present invention, there is provided a display apparatus having the construction described above, comprising a display control unit for displaying as such a compressed image signal without increasing a data quantity of the image signal.

In the present invention, when pixels are constituted into a block of N rows×N' columns, for example, a gray signal having an n value smaller than N×N' is defined by a look-up table, and an identification signal for the gray scale signal is transferred to each pixel inside the block. In this way, the display control unit can display a greater quantity of information without expanding the image signals.

As a concrete construction, a display apparatus according to the present invention comprises pixels arranged in matrix in a row direction and in a column direction; a pixel electrode disposed inside each of the pixels; a display device disposed inside each of the pixels, for executing display in accordance with a voltage of the pixel electrode; a scanning line driving circuit for supplying a scanning signal to a scanning line; an identification signal line driving circuit for supplying an identification signal to an identification signal line so disposed as to substantially cross the scanning line; a storage unit for storing the identification signal supplied from the identification signal line in the pixel; a gray scale voltage line driving circuit for supplying a gray scale voltage to two gray scale voltage lines for supplying the gray scale voltage to each of the pixels; a selection unit for selecting the gray scale voltage supplied to the gray scale voltage lines on the basis of the identification signal stored in the storage unit; a switching device for applying the selected gray scale voltage to the pixel electrode; and a gray scale write line driving circuit for supplying a gray scale write signal to a gray scale write line for controlling the switching device.

In the display apparatus according to the present invention, the display device comprises a light modulator using a liquid crystal; two of the gray scale voltage lines are provided to one pixel; the storage unit comprises a first active device connected to the identification signal line by use of the scanning line as a gate terminal and a pixel internal memory capacitance; the selection unit comprises n and p type active devices having a gate terminal thereof connected to the pixel internal memory capacitance, and connected to the two gray scale voltage lines, respectively; and the switching device comprises an n type active device and a p type active device using the gray scale write line as a gate terminal, and a fourth active device connected to the pixel electrode.

In the display apparatus according to the present invention, two gray scale voltage lines are disposed for one pixel; the storage unit comprises a first active device connected to the identification signal line by use of the scanning line as a gate terminals, and a pixel internal memory capacitance; the selection unit comprises an n type active device and a p type active device having a gate terminal thereof connected to the pixel internal memory capacitance, and connected to the two gray scale voltage lines, respectively; the switching device comprises n and p type active devices using the gray scale write line as a gate terminal, and a fourth active device connected to the pixel electrode; and the display device is an LED device driven by a fifth active device using the pixel electrode as a gate terminal.

DESCRIPTION OF THE EMBODIMENTS

Embodiments of the present invention will be explained hereinafter with reference to the accompanying drawings.

Figure 3:
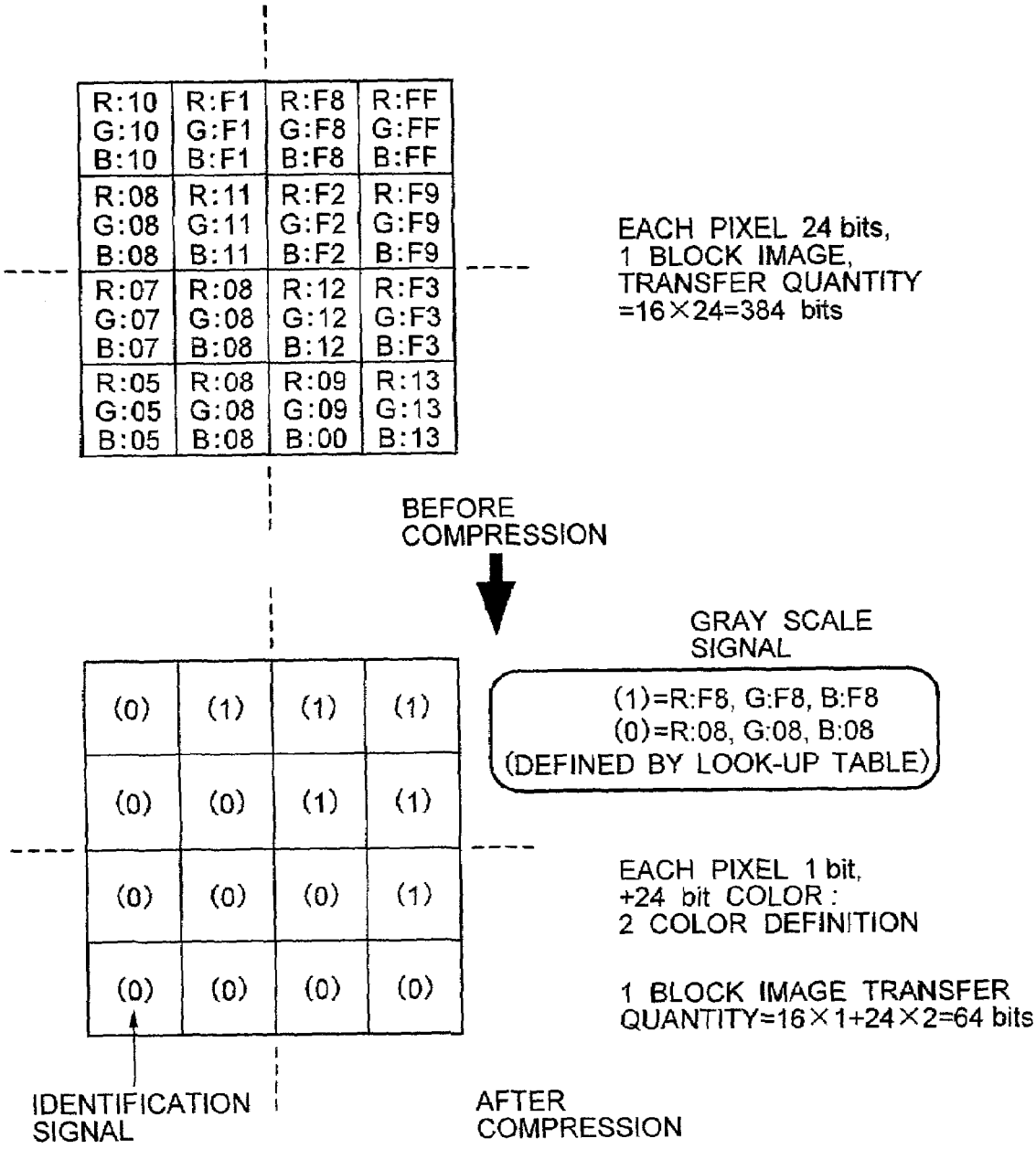
FIG. 3 is a table showing an image data format that the display apparatus shown in FIG. 1 receives.

Embodiment 1:

Referring initially to FIG. 3, an image data format that a display apparatus according to the present invention receives will be explained.

Image data is generally expressed as a group of pixels having gray scale data for each color. In the image format widely used in PC (personal computer), for example, each pixel data is separated into the three primary colors of red (R), green (G) and blue (B), and is described as data of 8 bits=256 gray scales from lightness to darkness for each color. The image information quantity of one pixel is in this case 8 bits×3 (colors)=24 bits. One screen image data as a group of these pixel data is referred to as a "bit map". In an image output source of PC or the like, a memory stores this bit map. A conventional image outputting method outputs the data from the upper left part to the lower right part of the bit map in a dot sequential driving system. On the other hand, the display apparatus receives the data outputted in the dot sequential system, expands the data into planar data by the dot sequential system or the line sequential system as described above, and then images and displays the data. Depending on types, the display apparatus includes a memory corresponding to a capacity of about one screen data, once stores the bit map it receives, expands the bit map inside the memory, converts it again to the display form and then displays the data.

In the system that outputs the bit map in the pixel sequential system, the increase of the band of the transmission system becomes necessary when the information quantity of images increases, as described above. Therefore, several methods have been proposed that compress the bit map to the extent such that degradation is much noticeable to human eyes, and then transfer the bit map so compressed. The upper half portion of FIG. 3 represents the bit map in its original data format as the data system before compression. Assuming that 4×4 pixels constitute one block, the information quantity of this one block before compression is 384 bits. This is compressed in accordance with the following rule.

(1) Assuming that N×N' pixels constitute one block (4×4 pixel, in this embodiment), the block is approximated by two gray scales.

(2) A look-up table is used to separately define two gray scales, and an identification signal defined by this table is allocated to each pixel.

In this case, the information to be transferred is the two gray scale information, that is, 24 bits×2, and the identification information of each pixel of 1 bit. The data quantity of one block becomes 64 bits, and compression of ⅙ is applied. This compression method compresses not only resolution of the pixels in one block in a spatial direction but also the gray scale number. Therefore, the resulting signal is the image signal to which compression is applied in both the spatial axis and the gray scale axis. The display apparatus in this embodiment receives the image signals the gray scale of which is compressed to 2 with 4×4 pixels constituting one block as described above. However, the number of pixels constituting one block is not limited to 4×4, and the gray scale after compression is not limited to 2, in particular.

Figure 2:
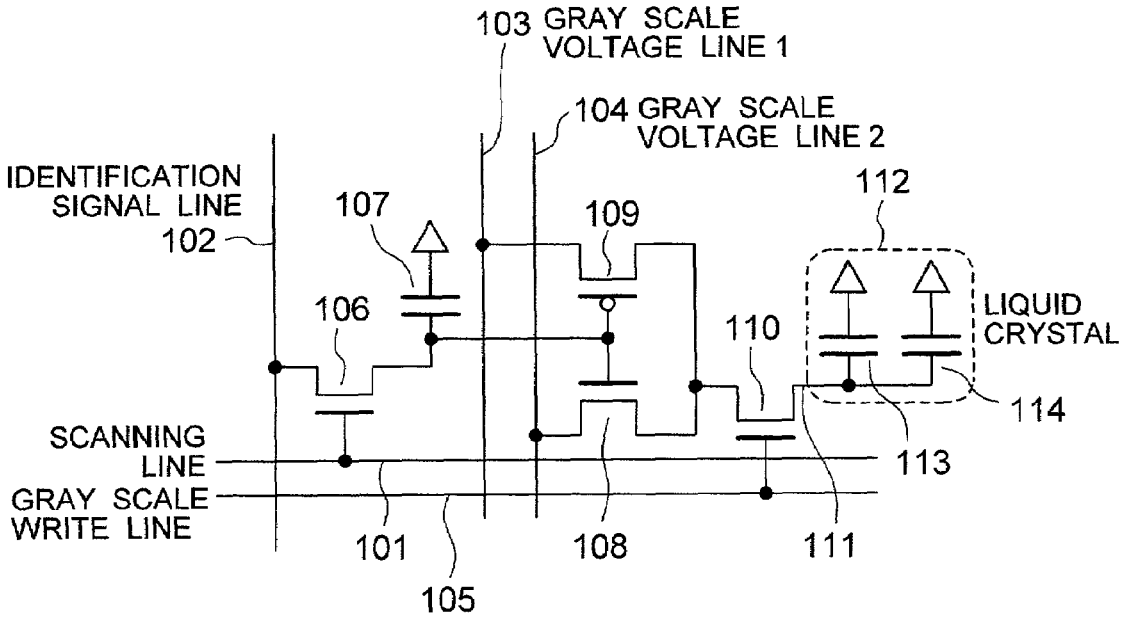
FIG. 2 is a pixel circuit diagram of the display apparatus shown in FIG. 1.

Next, FIG. 2 shows a pixel circuit diagram in the display apparatus of this embodiment. Scanning lines 101 and identification signal lines 102 are formed in a matrix shape, and a first active device 106 is disposed at each intersection in such a fashion that the scanning line 101 serves as a gate terminal. When a select voltage is applied to the scanning line 101, the first active device 106 writes the potential of the identification signal line 102 to a pixel memory 107. Here, the potential of the identification signal line 102 is acquired by converting the identification signal at each pixel explained with reference to FIG. 3 to a voltage. The identification signal potential written into the pixel memory 107 renders either an n type active device 108 or a p type active device 109 conductive, and either the voltage applied to a gray scale voltage line 1 (103) or the voltage applied to a gray scale voltage line 2 (104), to which each active device is connected, is outputted up to the fourth active device 110. Here, the voltage applied to the gray scale voltage line 1 (103) or the gray scale voltage line 2 (104) is acquired by converting the gray scale signal defined by the look-up table in each block explained in FIG. 3 to the voltage value.

Subsequently when the select voltage is applied to a gray scale write line 105, the fourth active device 110 becomes conductive and the gray scale voltage is outputted to a pixel electrode 111. The voltage of this pixel electrode 111 controls a light modulator 112 and the image is displayed. In this embodiment, the light modulator 112 comprises a holding capacitance 113 and a liquid crystal 114, and the electro-optical effect of the liquid crystal modulates the transmitted light.

Figure 4:
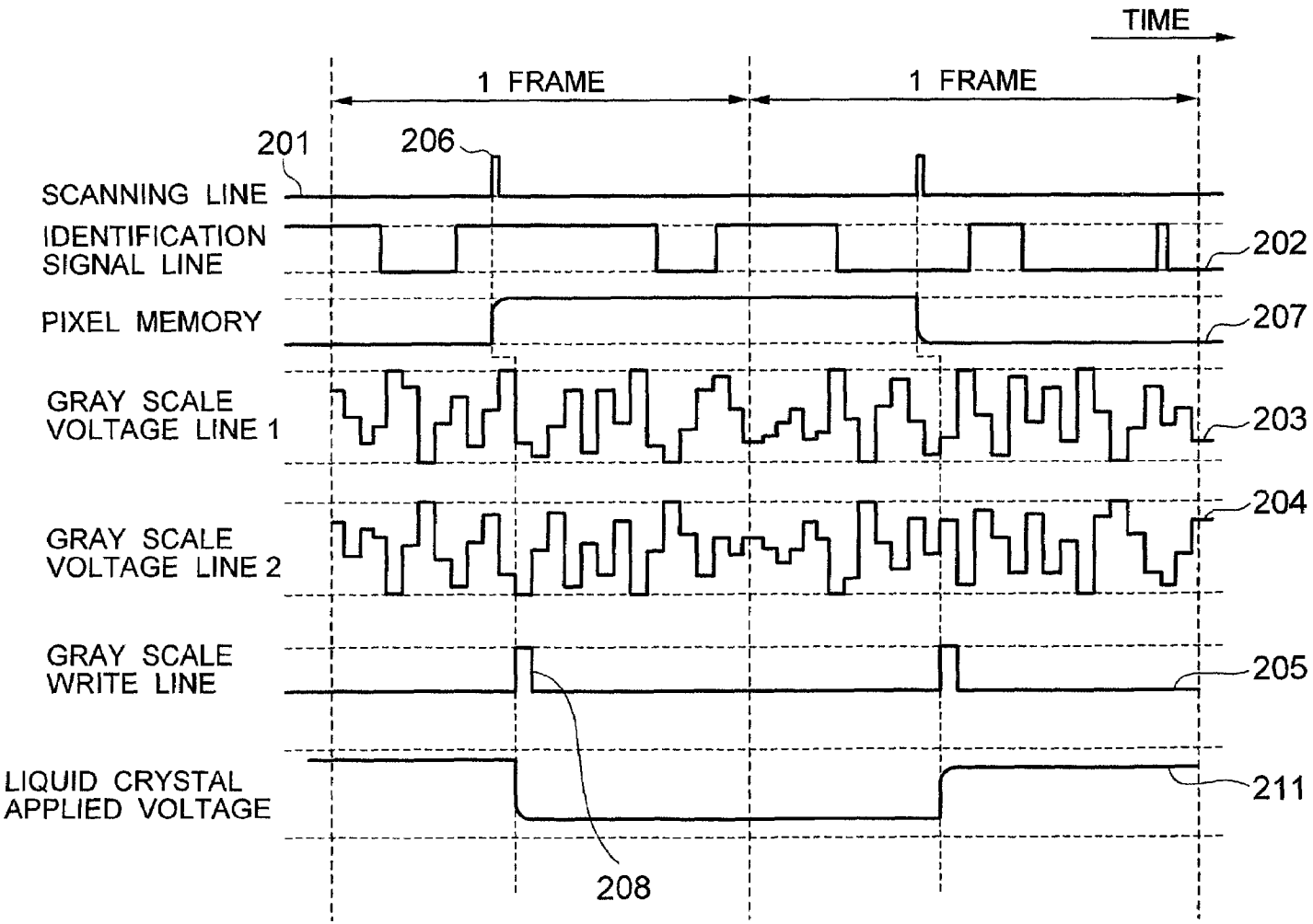
FIG. 4 is a waveform diagram showing a driving method of the display apparatus shown in FIG. 1.

Next, a driving method of the display apparatus of this embodiment will be explained with reference to FIG. 4. Since 4×4 pixels constitute one block in this embodiment, the driving method, too, is considered with 4 rows as a unit. However, FIG. 4 shows the driving method of only one pixel among them.

The scanning pulses 206 sequentially scan the scanning lines from above to below in the same way as in the prior art method. The potential 202 of the identification signal line is transferred to the potential 207 of the pixel memory at the point at which the scanning pulse 206 is inputted to the potential 201 of the scanning line, in the same way as described above, too. Here, the potential 202 of the identification signal line assumes either of two digital potentials of high (Hi) and low (Lo) at any point. The value written to the pixel memory 107 needs have accuracy only to such an extent that it exceeds a threshold voltage of an n or p type active device. Therefore, even when the scanning lines 101 are sequentially scanned at a high speed and the time width of the scanning pulse 206 becomes small, a write operation can be sufficiently conducted.

At the point at which the write operation of the identification signal to the pixel memory 107 is completed for 4 rows, the gray scale write pulse 208 is applied to the potential 205 of the gray scale write lines of 4 rows. In other words, sequential scanning of the scanning line 101 is made one row by one, but scanning of the gray scale write line 105 is made in the four-row unit.

This write pulse 208 writes the gray scale voltage from the gray scale voltage line 1 or from the gray scale voltage line 2 to the pixel electrode 111. Since the time corresponding to four scanning pulses is secured, the write operation can be sufficiently made even by use of an analog voltage value calling for accuracy of 256 gray scales.

According to such pixel structure and driving method, the time necessary for writing the gray scale voltage requiring high accuracy is four times the scanning period of one row. Therefore, line sequential scanning can be carried out at a speed higher by four times than the speed in the prior art method, and a greater quantity of information can be correctly displayed as much.

Figure 1:
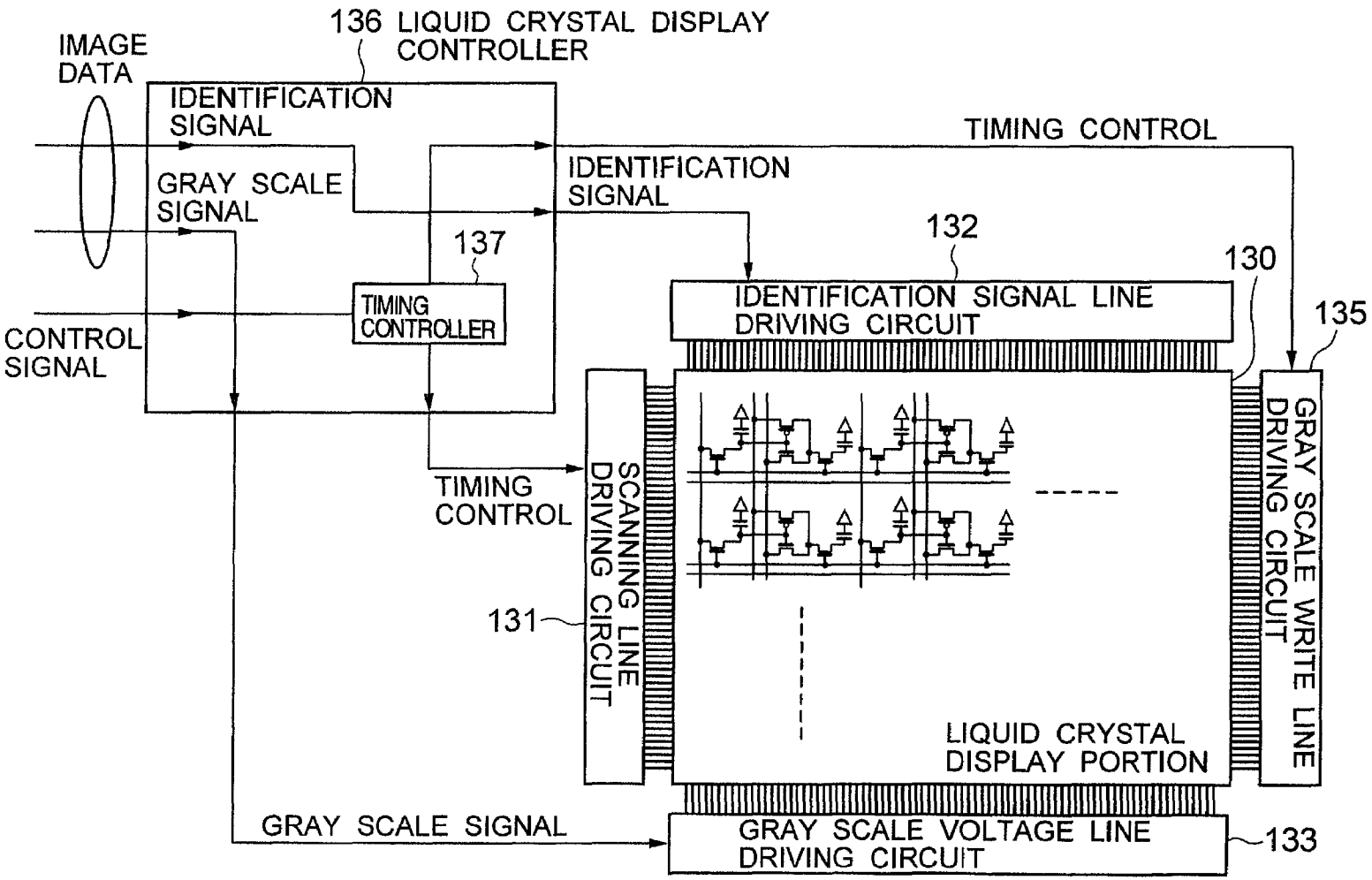
FIG. 1 is a block diagram of a display apparatus according to Embodiment 1 of the present invention.

Next, FIG. 1 is a block diagram of the display apparatus of this embodiment. The pixels shown in FIG. 2 are arranged in matrix in a liquid crystal display portion 130. Scanning lines 101, identification signal lines 102, gray scale voltage lines 1 (103) and 2 (104) as lead wires of the group of pixels and the gray scale write lines 105 are driven by a scanning line driving circuit 131, an identification signal driving circuit, a gray scale voltage line driving circuit 133 and a gray scale write line driving circuit 135, respectively. Each of these driving circuits is controlled by a liquid crystal display controller 136. Here, the liquid crystal display controller 136 receives the identification signal and the gray scale signal as the image data, and a vertical sync signal and horizontal sync signal as control signals, dot clocks, etc, from an image signal source. The liquid crystal display controller 136 merely adjusts the timing of these signals by a timing controller 137 without expanding them as a bit map, and outputs them as such.

As described above, the display apparatus of this embodiment (1) receives the image signals compressed in the spatial axis and the gray scale axis using 4×4 pixels as one block, and (2) uses the data as such for the display data without expanding them. Therefore, the circuit scale of the display controller need not be enlarged and the cost can be kept at a low level. Furthermore, (3) since high speed driving is possible, large quantities of information can be correctly displayed.

Though this embodiment uses 4×4 pixels to constitute one block, n×n' pixels may be used to constitute one block with the same structure and the same driving method.

Figure 5:
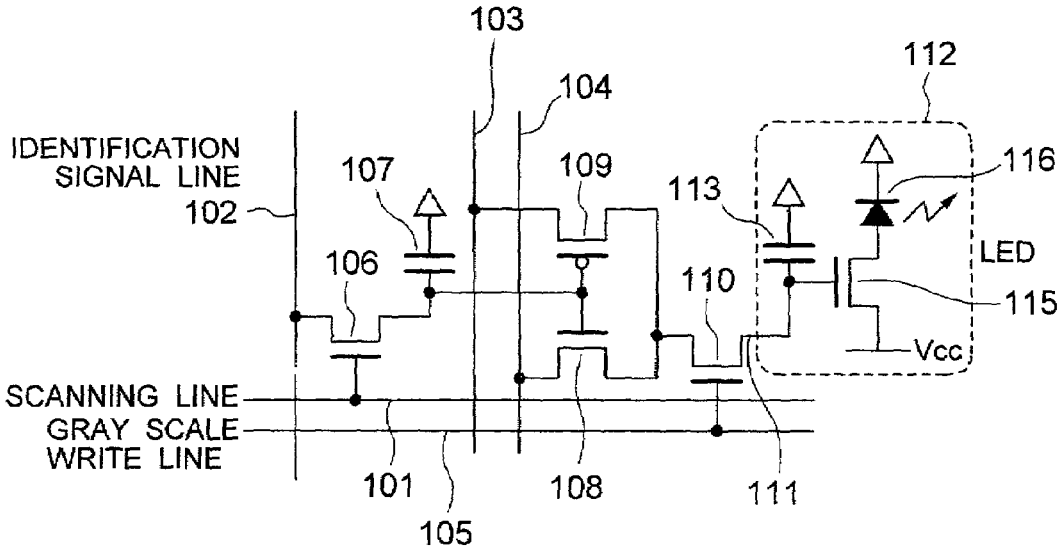
FIG. 5 is a pixel circuit diagram of a display apparatus according to Embodiment 2 of the present invention.

Embodiment 2:

Next, Embodiment 2 will be explained. FIG. 5 shows a pixel circuit diagram of the display apparatus of this embodiment. This embodiment is different from Embodiment 1 in the construction of the light modulator 112. Namely, the light modulator 112 of this embodiment comprises an LED light modulator including a holding capacitance 113, a fifth active device 115 using the pixel electrode 111 as its gate terminal and an LED device 116 connected to a current source through the fifth active device 115. The construction of this embodiment other than the light modulator 112 is the same as that of Embodiment 1.

The gray scale voltage written to the pixel electrode 111 is simultaneously written to the holding capacitance 113, too. This voltage drives the fifth active device 115 and controls the current flowing through the LED (Light Emitting Diode) device 116 to thereby modulate a light emission quantity. When the LED light modulator is used as the light modulator 112 in this way, response is faster than that of the light modulator using the liquid crystal, and the write time of the gray scale voltage can be made shorter. As a result, line sequential scanning at a higher speed becomes possible and a display apparatus capable of displaying a greater quantity of information can be obtained.

In the same way as in Embodiment 1, this embodiment (1) receives the image signals to which compression is applied in the spatial axis and the gray scale axis with one block constituted by 4×4 pixels, and (2) uses the received data as such for the display data without expanding the data to the bit map. Therefore, the circuit scale of the display controller need not be expanded and the cost can be suppressed to a low level. Furthermore, (3) since the display apparatus of this embodiment can operate at a higher speed than that of Embodiment 1, it can correctly display a larger quantity of information.

Figure 6:
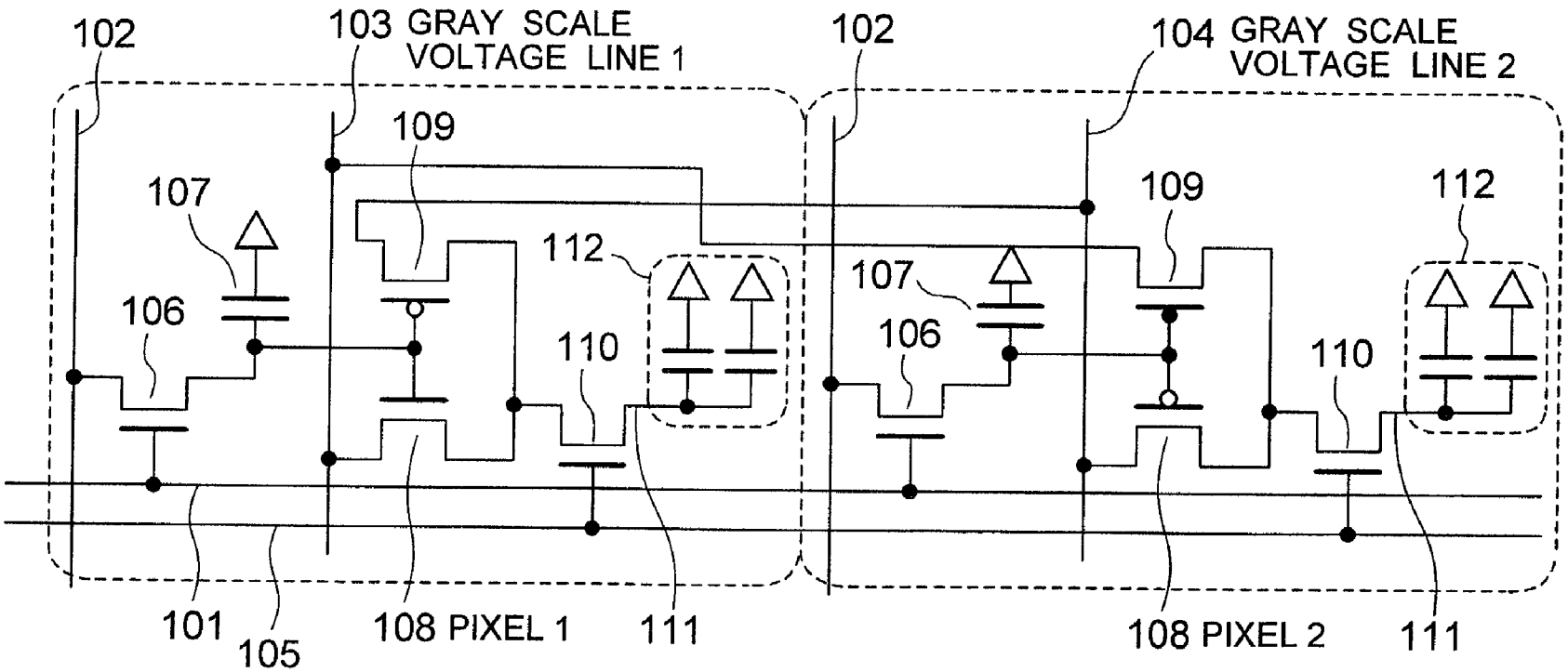
FIG. 6 is a pixel circuit diagram of a display apparatus according to Embodiment 3 of the present invention.

Embodiment 3:

Next, Embodiment 3 will be explained. FIG. 6 shows a pixel circuit diagram of the display apparatus of this embodiment. In Embodiment 1, the gray scale voltage lines (1 and 2) are connected to each pixel. In this embodiment, however, mutually adjacent pixels share the gray scale voltage lines, and the display apparatus is functionally and substantially equivalent. The only limitation is that one block can be constituted by only (2n pixels in the transverse direction)×(n' pixels in the vertical direction) though one block can be constituted by n×n' pixels (n and n': arbitrary numbers) in Embodiment 1. In practice, however, the number of pixels in both longitudinal and transverse directions of one block is even-numbered in most cases, and this limitation hardly becomes a problem.

Since this embodiment can decrease the number of lead wires per pixel, short-circuit among the lead wires can be reduced during production and the yield can be improved. In consequence, the display apparatus can be produced at a lower cost. The decrease of the number of lead wires results in improvement of the aperture ratio of the liquid crystal display portion, too. Therefore, when a backlight having the same lightness is used, the display apparatus can achieve brighter display.

As described above, in the same way as in Embodiment 1, this embodiment (1) receives the image signals to which compression is applied in the spatial axis and the gray scale axis with one block constituted by 4×4 pixels, and (2) uses the received data as such for the display data without expanding the data to the bit map. Therefore, the circuit scale of the display controller need not be expanded and the cost can be suppressed to a low level. Furthermore, (3) since the display apparatus can operate at a higher speed, it can correctly display a larger quantity of information and becomes brighter in display at a lower cost of production.

Figure 7:
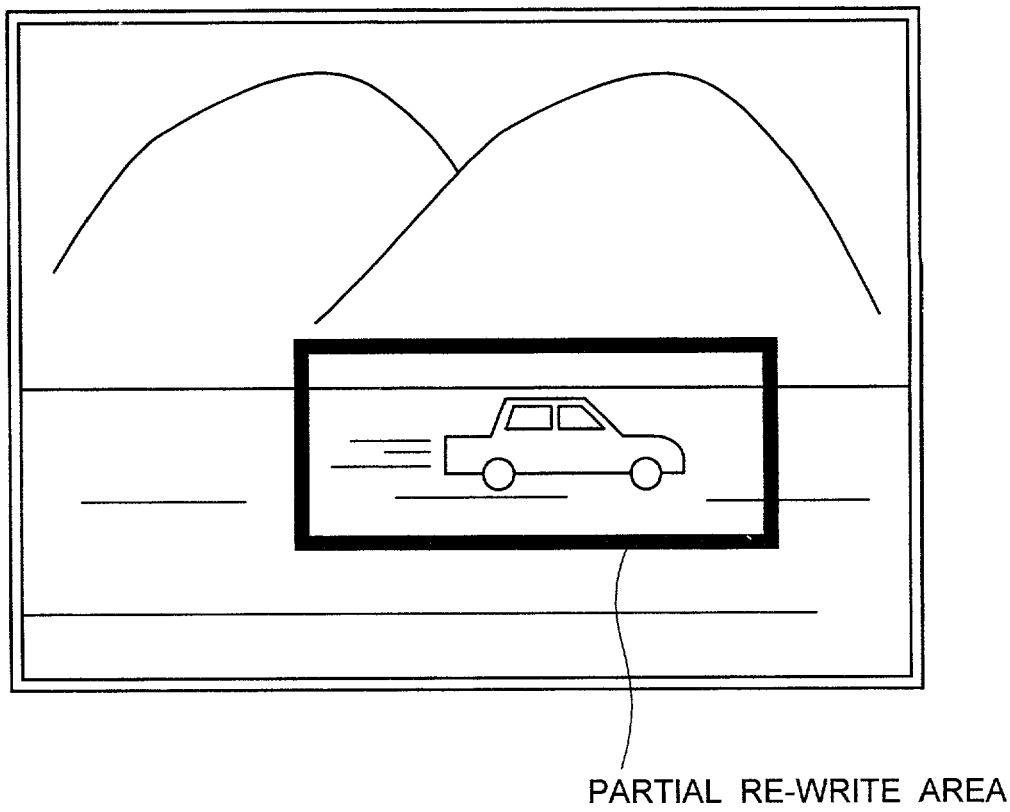
FIG. 7 is an explanatory view useful for explaining a compression system by Embodiment 4.

Embodiment 4:

Embodiment 4 of the present invention will be explained. The image data that the display apparatus of this embodiment receives is fundamentally the same as the compression method of Embodiment 1. In this embodiment, however, the transfer data is not the compression data for all the bit maps of one screen but is the compression data of the bit maps of only the regions requiring re-write in comparison with the just one preceding frame on the screen as shown in FIG. 7. This is an effective data transfer system when the information quantity to be displayed on the display apparatus, hence, the data transfer quantity, increase, in the same way as the PV link system described already that transfers the bit map to only the region requiring a re-write operation. In this case, a signal for designating the re-write region is transferred as a control signal, too.

As described above, the data format the display apparatus of this embodiment receives is the format that (A) deals with only the area requiring re-write, (B) approximates each block consisting of 4×4 pixels by two gray scales, (C) separately defines the two gray scales by the look-up table and allocates the identification signal defined by the table to each pixel and (D) simultaneously transfers the area control signal when the data is transferred.

Figure 9:
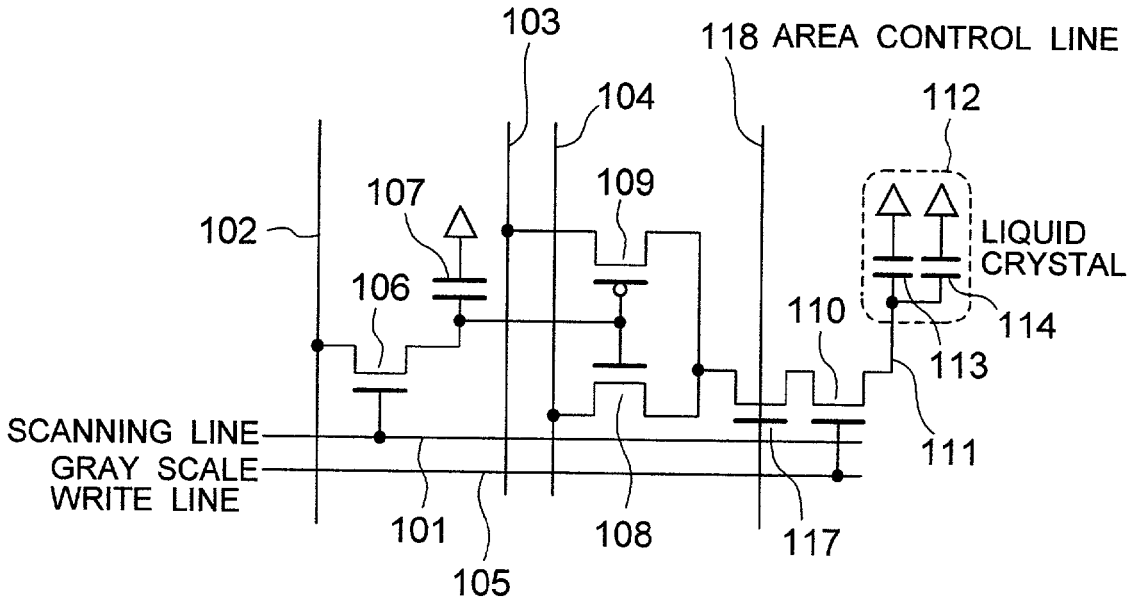
FIG. 9 is a pixel circuit diagram of the display apparatus shown in FIG. 8.

FIG. 9 shows a pixel circuit diagram in the display apparatus of this embodiment. In this embodiment, an area control active device 117 is disposed between the outputs of n and p type active devices 108 and 109 and a fourth active device 110. An area control line 118 connected to the gate terminal of the area control active device 117 is disposed in an orthogonal direction to a gray scale write line 105. Incidentally, the area control active device 117 may be interposed between the fourth active device 110 and the pixel electrode 111. The rest of the constructions are the same as those of Embodiment 1.

The driving method in the driving apparatus of this embodiment is substantially the same as that of Embodiment 1. Because the area control active device 117 is added, however, the voltage of the pixel electrode 111 is re-written only when the pulse is applied to the area control line 118 in synchronism with the gray scale write pulse 208 (see FIG. 4) when applying the gray scale voltage to the pixel electrode 111.

Figure 8:
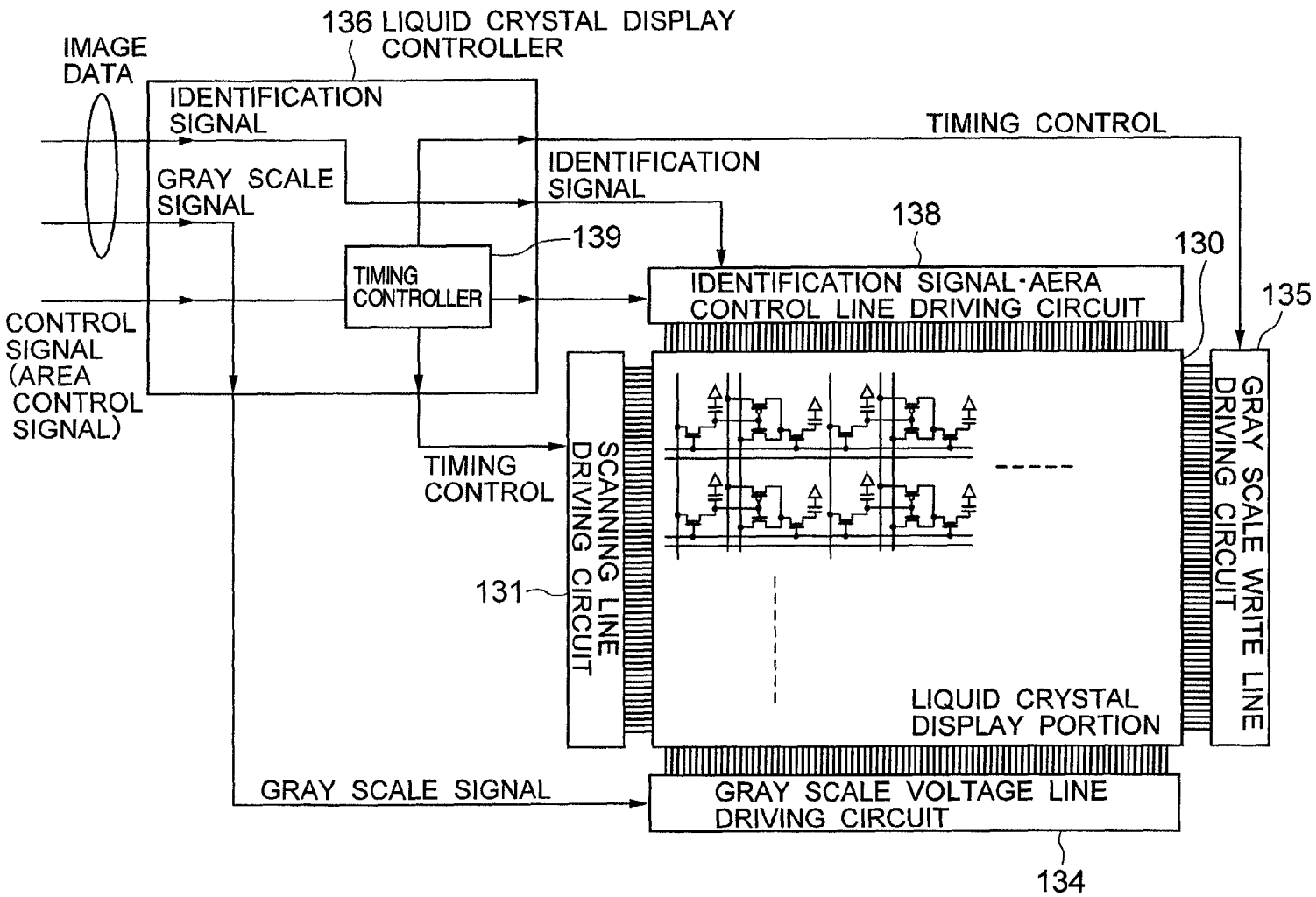
FIG. 8 is a block diagram of a display apparatus according to Embodiment 4.

FIG. 8 is a block diagram of the display apparatus of this Embodiment 4. An identification signal line/area control line driving circuit 130 formed by integrating an area control line driving circuit with an identification signal line driving circuit is provided to the liquid crystal display portion 130. An area control timing controller 139 is further disposed inside the liquid crystal display controller 136.

In this pixel structure, display of the region for which both the area control line and the gray scale write line 105 are selected is re-written. An area control timing controller 139 controls these area control line 118 and gray scale write line 105 on the basis of the control signals such as the horizontal sync signal and the vertical sync signal transferred from the image signal source and the area control signal. The image data must be outputted to the scanning line 101, the identification signal line 102 and the gray scale voltage lines 103 and 104 of the re-write area, too, and the area control timing controller 139 also controls such image data.

In the display apparatus of this embodiment, it is necessary to designate the region that requires re-write by comparing the image with the one previous image and to re-write the designated region. It is therefore necessary to analyze the sent control signal and to regulate the timing of each lead wire. For this reason, the circuit scale of the liquid crystal display controller 136 becomes somewhat greater than that of Embodiment 1 but not drastically because the system is not the one that expands the sent image data to the bit map inside the memory on the display apparatus side but can display as such the transfer data.

As described above, the display apparatus of this embodiment (1) receives the image signals, to which compression is applied in both spatial axis and gray scale axis, with 4×4 pixels forming one block, for only the region requiring re-write, and (2) uses the reception data as such for display data without expanding it to the bit map, in the same way as the foregoing embodiments. Therefore, the display apparatus need not drastically expand the circuit scale of the display controller but can keep the cost at a low level. Furthermore, (3) because the display portion can operate at a high speed, large quantities of information can be displayed correctly.

In this embodiment, too, one block is not limited to 4×4 pixels, in particular, but may be constituted by n×n' pixels by using the same construction and the same driving method.

In this embodiment, the adjacent pixels can share the gray scale voltage line, and an LED device can be used for the light modulator.

When the area control line is always kept under the select state, the display apparatus can of course receive exactly the same compressed data as the data in Embodiment 1.

Figure 10:
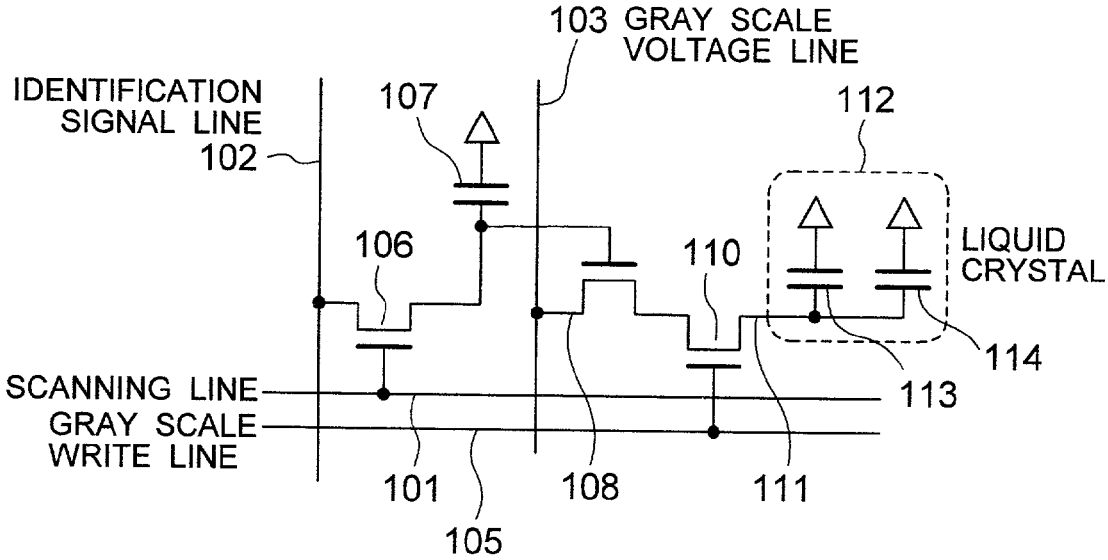
FIG. 10 is a pixel circuit diagram of a display apparatus according to Embodiment 5.

Embodiment 5:

Next, Embodiment 5 will be explained. FIG. 10 shows a pixel circuit diagram in the display apparatus of this embodiment. In Embodiment 1, two gray scale voltage lines (1 and 2) are connected to each pixel. In this embodiment, however, only one gray scale voltage line 103 is connected to each pixel. Further, the device corresponding to the p type active device is not disposed, but only a second active device 108 corresponding to the n type active device is disposed. Therefore, all of the three active devices 106, 108 and 110 inside the pixel are of a unipolar type. Therefore, the fabrication process of each active device needs to fabricate only the unipolar type or in other words, the active device can be fabricated by a method that can fabricate only a unipolar active device. In either case, the production cost becomes low.

Figure 11:
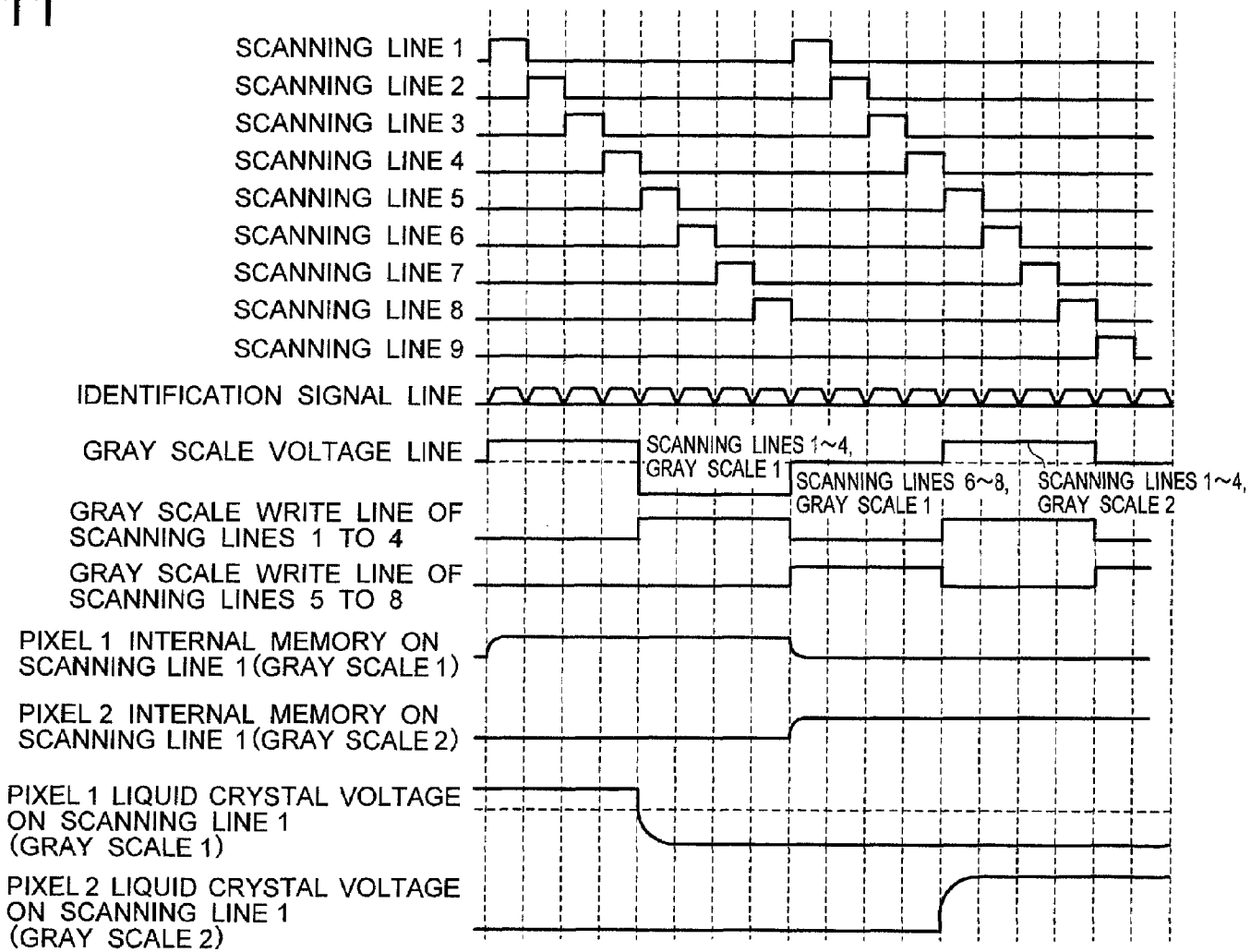
FIG. 11 is a diagram showing a driving method of the di splay apparatus shown in FIG. 10.

Since only one gray scale signal line exists in this embodiment, the gray scale voltage can be written to only the pixel of one gray scale inside one block by a signal gray scale write pulse. To write two gray scales, therefore, the gray scale write pulses and the scanning pulses for two write operations are necessary. FIG. 11 shows this double scanning driving method.

Since one block comprises 4 rows×4 columns, the scanning lines are scanned from 1 to 4 to write the identification signal Hi to the pixels for displaying the first gray scale inside each block. While the scanning lines 5 to 6 are scanned, the gray scale write lines of the scanning lines 1 to 4 are selected and the potential of the first gray scale corresponding to each block of the scanning lines 1 to 4 is written into the pixel electrodes 111. In the mean time, the second active device 108 of the pixel for displaying the second gray scale does not become conductive, and the gray scale voltage is not applied to the pixel electrode even when the gray scale write line is selected. Subsequently, after the scanning lines 5 to 8 are scanned, the scanning lines 1 to 4 are again scanned. The scanning operation of this time writes the Hi identification signal to the pixels for displaying the second gray scale inside each block, the gray scale voltage of the second gray scale is written to the pixel electrodes of these pixels while the subsequent scanning lines 5 to 8 are scanned.

According to this double scanning driving method, each pixel must be scanned twice to depict one screen. Therefore, the driving speed is not so high as in Embodiment 1 but is higher than in the ordinary line sequential driving method. Therefore, greater quantities of information can be displayed.

Figure 12:
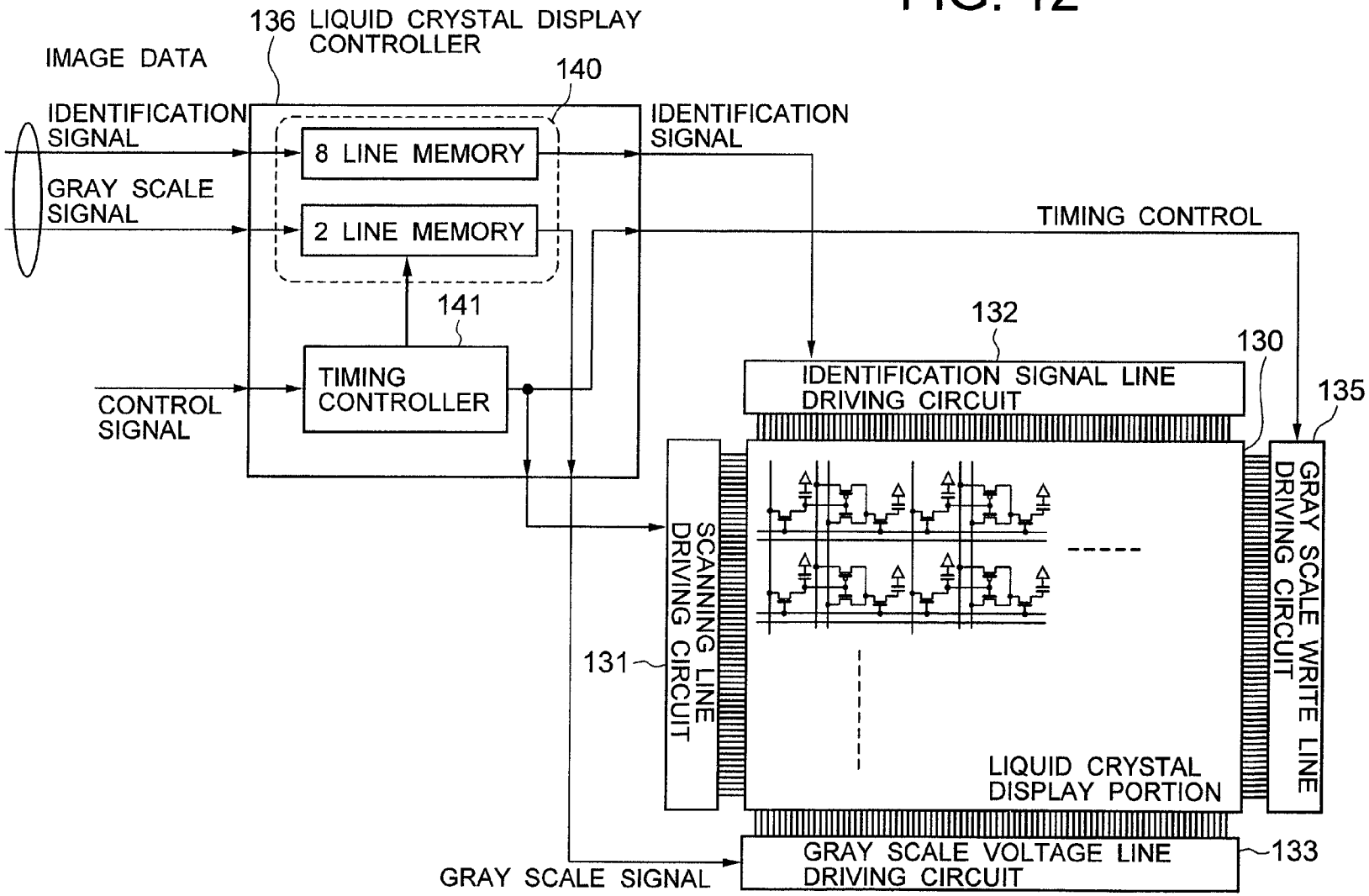
FIG. 12 is a block diagram of the display apparatus shown in FIG. 10.

FIG. 12 is a block diagram of the display apparatus of this embodiment. In this embodiment, a double scanning timing controller 141 is disposed inside the liquid crystal controller 136, and controls double scanning of the scanning lines 101 and the gray scale write lines 105. A line memory 140 is disposed inside the liquid crystal controller 136. This line memory 140 includes an 8-line memory for identification signals, for storing the identification signal and the gray scale signal as the image data till the second operation of double scanning and a 2-block line memory for the gray scale signal. Since this embodiment displays the image by double scanning in this way, the circuit scale of the liquid crystal display controller 136 becomes somewhat greater than that of Embodiment 1 but not so drastically because this embodiment does not employ the system that expands the sent image data to the bit map inside the memory on the display apparatus side, but can display as such the transfer data.

In the same way as each of the foregoing embodiment, the display apparatus of this embodiment (1) receives the image signals compressed in the spatial axis and the gray scale axis with one block comprising 4×4 pixels, (2) uses the received data as such for the display data without expanding it to the bit map. Therefore, the display apparatus need not drastically increase the circuit scale of the display controller. Furthermore, (3) since the display portion uses only the unipolar active devices, the display apparatus can be produced at a low production cost. Because higher driving can be made than the ordinary line sequential driving system, the display apparatus can correctly display greater quantities of information.

Incidentally, in this embodiment, too, the light modulator may use the LED device. Though one block comprises 4×4 pixels, one block may also comprise n×n' pixels using the same construction and the same driving method.

Further, the number of gray scales defined inside one block is 2 in this embodiment, but the number of gray scales defined inside one block can be increased when the number of times of scanning is increased.

Figure 13:
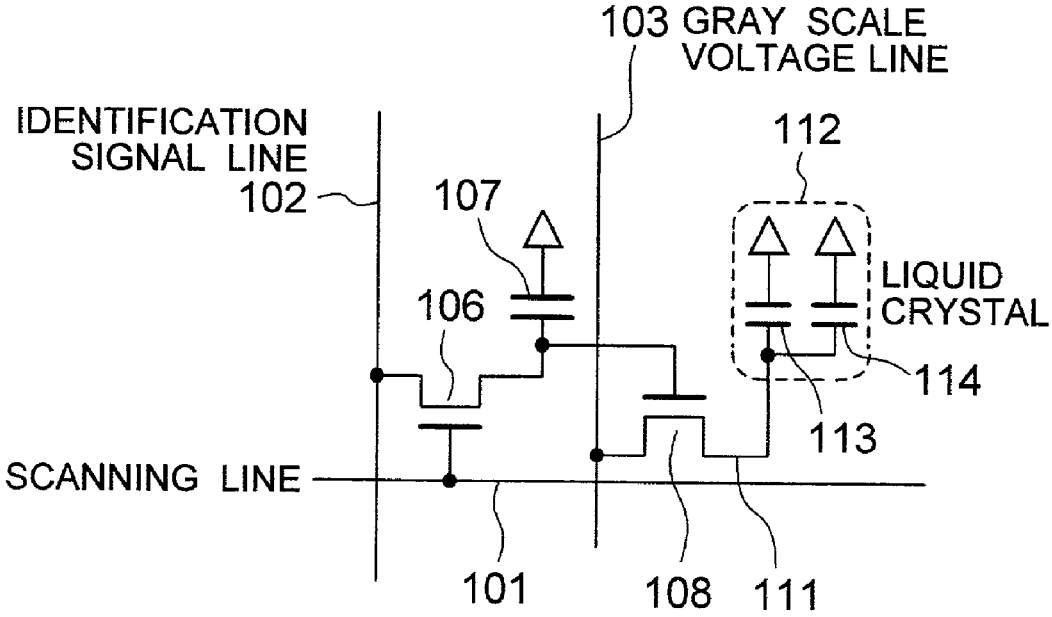
FIG. 13 is a pixel circuit diagram of a display apparatus according to Embodiment 6.

Embodiment 6:

Next, Embodiment 6 will be explained. FIG. 13 shows a pixel circuit diagram in the display apparatus of this embodiment. In this embodiment, the gray scale write line 105 that exists in each of the foregoing embodiments does not exist, and the active device 110 to the gate of which the gray scale write line 105 is connected does not exist, either. The output of the second active device 108 is directly connected to the pixel electrode 111. Since one active device and one lead wire can thus be saved, the yield in the production process can be further improved, and the display apparatus can be fabricated at a reduced cost of production.

Figure 14:
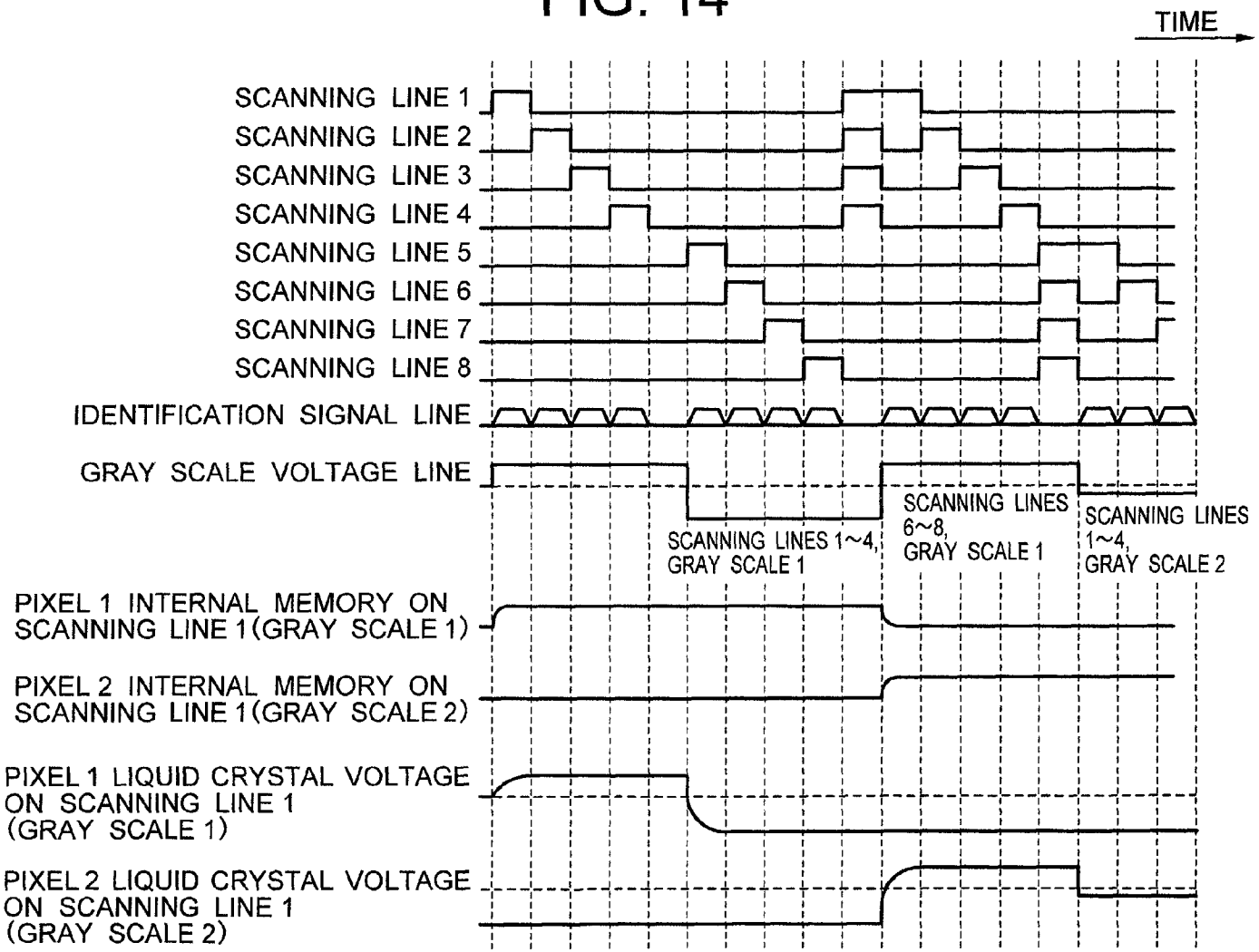
FIG. 14 is a diagram showing a driving method of the display apparatus shown in FIG. 13.

Since the display apparatus of this embodiment does not have the gray scale write line, the gray scale voltage applied to the gray scale voltage line 103 is always written to the pixel electrode 111 of the pixel inside the pixel internal memory 107 to which the Hi identification signal is written, even though the gray scale voltage is not the gray scale voltage for this block. To cope with this problem, a further contrivance is made to the double scanning driving method so that the scanning line is again selected after the gray scale voltage is written and the Lo identification signal is written into the memory internal memory 107. FIG. 14 shows this circuit arrangement.

After the scanning lines 5 to 8 are selected, the scanning lines 1 to 4 are simultaneously selected and the Lo identification signal is written into the pixel internal memories 107 of all the pixels. In this way, the potential of the gray scale voltage at this point is held finally in the pixel electrode 111. After the scanning lines 1 to 4 are scanned thrice, the scanning lines 5 to 8 are similarly and simultaneously selected and the pixel electrode potential of the pixels connected to the scanning lines 5 to 8 is determined. The driving method of this embodiment needs the time in which four scanning lines are simultaneously selected to determine the pixel electrode potential and the driving speed becomes lower than in the double scanning driving method of Embodiment 5. Nonetheless, the driving speed is higher than the ordinary line sequentially driving methods, and this method can display greater quantities of information.

Figure 15:
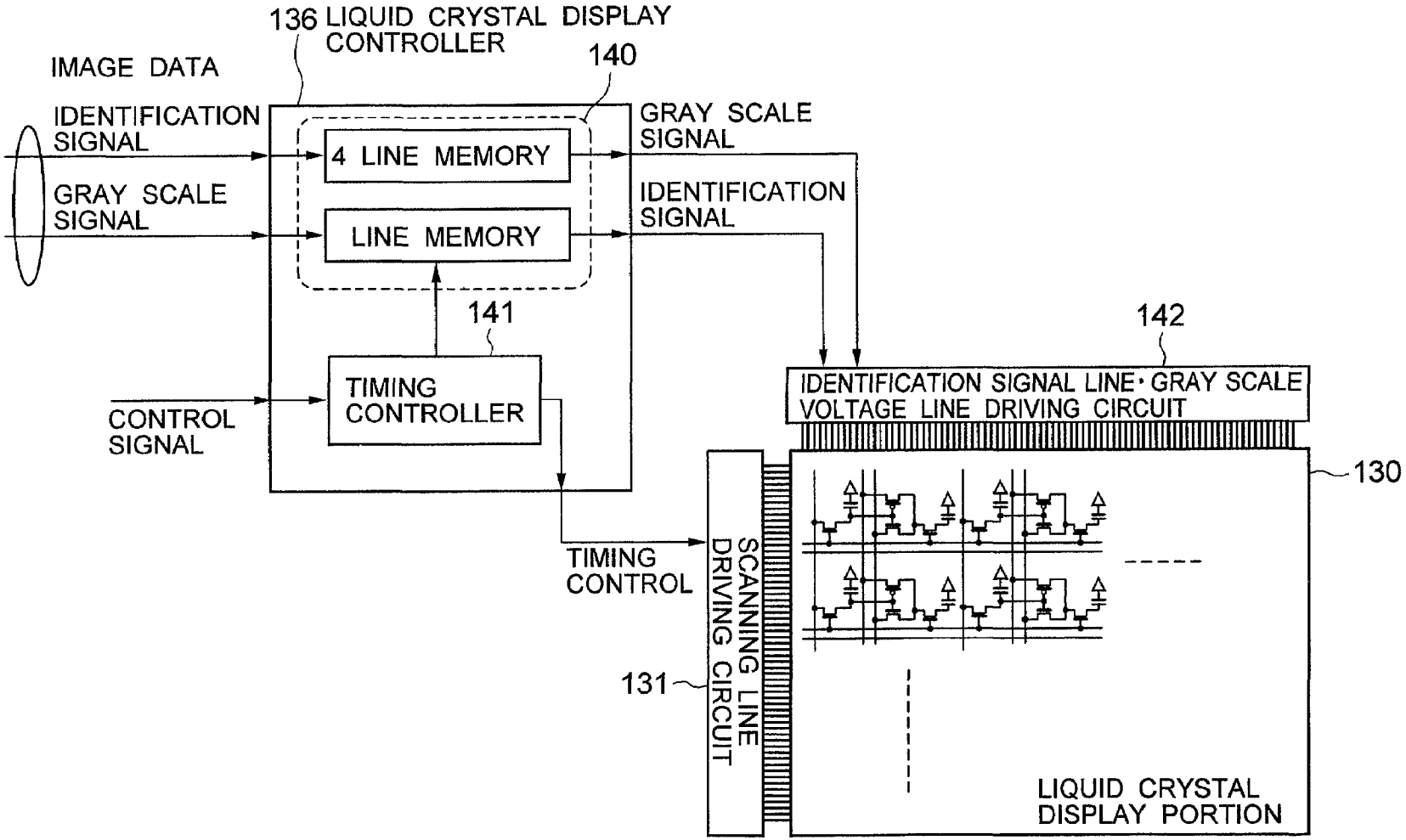
FIG. 15 is a block diagram of the display apparatus shown in FIG. 13.

FIG. 15 shows a block diagram of the display apparatus of this embodiment. In comparison with Embodiment 5, this embodiment does not have the gray scale writing/driving circuit but includes an identification signal line/gray scale voltage line driving circuit 142 fabricated by integrating the gray scale voltage line driving circuit with the identification signal line driving circuit. The integration of the identification signal line driving circuit and the gray scale voltage line driving circuit is not the subject matter of the present invention and is not mentioned hereby specifically. However, because the gray scale writing/driving circuit does not exist, the cost of the constituent members of this circuit can be eliminated, and the overall cost of production can be lowered.

In the same way as each of the foregoing embodiments, the display apparatus of this embodiment (1) receives the image signals compressed in the spatial axis and the gray scale axis with one block comprising 4×4 pixels, and (2) uses the received data as such for the display data without expanding it to the bit map. Therefore, the display apparatus need not drastically increase the circuit scale of the display controller. Furthermore, (3) since the display portion uses only two unipolar active devices, the display apparatus can be produced at a lower production cost than in Embodiment 5. Because driving can be made at a higher speed than the ordinary line sequential driving system, the display apparatus can correctly display greater quantities of information.

Incidentally, in this embodiment, too, the light modulator may use the LED device. Though one block comprises 4×4 pixels, one block may also comprise n×n' pixels using the same construction and the same driving method.

In this embodiment, the number of gray scales defined inside one block is 2, but can be increased by increasing the number of times of scanning.

Figure 16:
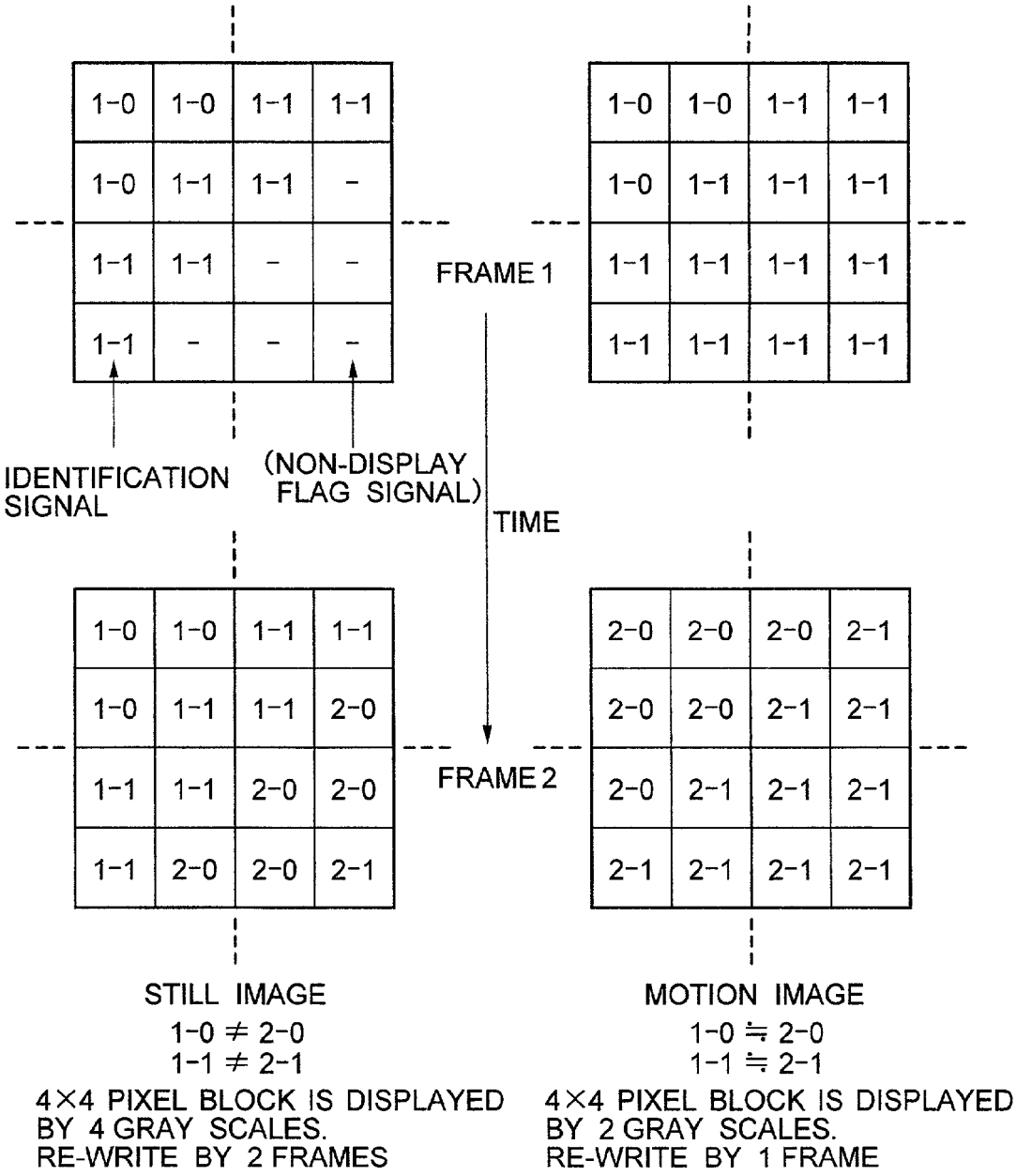
FIG. 16 is a table showing a compression data format that the display apparatus according to Embodiment 7 receives.

Embodiment 7:

Next, Embodiment 7 will be explained. The display data in the display apparatus of this embodiment uses fundamentally the same compression method as that of Embodiment 1. However, this embodiment employs the following method. As shown in FIG. 16, the image outputted from the image output source is judged. The number of gray scales inside one block is set to 2 for a motion image region in which any change exists from one previous frame, and the image data is transferred within one frame period. The number of gray scales is set to 4 inside one block for a still image region in which any change hardly exists from the one previous frame. In this case, the image data of the pixels for displaying the first and second gray scales are transferred for the first frame, and the image data of the pixels for displaying the third and fourth gray scales are transferred in the second frame. A flag signal for the pixels not displaying the gray scale in each frame is simultaneously transferred for the still image region. In the data transfer by such a system, the compression ratio of the image in the still image region becomes lower than in Embodiment 5. Therefore, display can be made with lower degradation.

The pixel structure and the driving method of this embodiment are almost the same as those of Embodiment 5. The only one difference is that the Hi identification signal is multiplied by the flag signal inside the liquid crystal display controller 136 and is then outputted lest the gray scale signal is written into the excessive pixels inside the still image region. The increase of the circuit scale resulting from the circuit necessary for this operation is only limited.

In the same way as each of the foregoing embodiments, the display apparatus of this embodiment (1) receives the image signals compressed in the spatial axis, the gray scale axis and the time axis with one block comprising 4×4 pixels, and (2) uses the received data as such for the display data without expanding it to the bit map. Therefore, the display apparatus need not drastically increase the circuit scale of the display controller. Furthermore, (3) since the display portion uses only the unipolar active devices, the display apparatus can be produced at a lower production cost. Because driving can be made at a higher speed than the ordinary line sequential driving system, the display apparatus can correctly display greater quantities of information and display with less deterioration compared with the embodiment 5 in the still image region.

Incidentally, in this embodiment, too, the light modulator may use the LED device. Though one block comprises 4×4 pixels, one block may also comprise n×n' pixels using the same construction and the same driving method.

In this embodiment, the number of gray scales defined inside one block is 2 in the dynamic region and is 4 in the still image region, but can be increased in each of the regions by increasing the number of times of scanning defined inside one block.

In this embodiment, the number of gray scales defined in one block of the still image region is 4 gray scales in two frame periods. However, it is possible to increase the number of bridging frame periods while the number of gray scales allocated to one frame is kept at 2 so as to attain 8 gray scales in 4 frame periods.

Embodiment 8:

Next, Embodiment 8 will be explained. The display data in the display apparatus of this embodiment uses the same data format compressed in the spatial axis, the gray scale axis and the time axis as in Embodiment 7. In this Embodiment 8, display can be made with less degradation in the still image region by the same compression data format when the liquid crystal display controller 136 is slightly changed in the same way as in Embodiment 7.

In the same way as each of the foregoing embodiments, the display apparatus of this embodiment (1) receives the image signals compressed in the spatial axis, the gray scale axis and the time axis with one block comprising 4×4 pixels, and (2) uses the received data as such for the display data without expanding it to the bit map. Therefore, the display apparatus need not drastically increase the circuit scale of the display controller. Furthermore, (3) since the display portion uses only the two unipolar active devices, the display apparatus can be produced at a lower production cost. Because driving can be made at a higher speed than the ordinary line sequential driving system, the display apparatus can correctly display greater quantities of information and moreover, with lesser degradation in the still image region than in Embodiment 6.

Incidentally, in this embodiment, too, the light modulator may use the LED device. Though one block comprises 4×4 pixels, one block may also comprise n×n' pixels using the same construction and the same driving method.

In this embodiment, the number of gray scales defined inside one block is 2 in the dynamic region and is 4 in the still image region, but can be increased in each of-the regions by increasing the number of times of scanning in one frame.

In this embodiment, the number of gray scales defined in one block of the still image region is 4 gray scales over 2 frame periods, but 8 gray scales over 4 frame periods can be achieved by increasing the number of frame periods while the number of gray scales allocated to each frame is kept at 2.

As explained above, the present invention (1) can receive the display data the substantial transfer capacity of which is improved such as the data of the PV link system or the image compression system covering the axial axis, the gray scale axis and the time axis, (2) need not drastically improve the processing capacity of the data processing circuit, and can therefore keep the cost of the display apparatus at a low cost. Further, the present invention can (3) normally display greater quantities of information.

What is claimed is:

1. A display apparatus comprising:

pixels arranged in matrix in a row direction and in a column direction;

a pixel electrode disposed inside each of said pixels;

a display device disposed inside each of said pixels, for executing display in accordance with a voltage of said pixel electrode;

a scanning line driving circuit for supplying a scanning signal to a scanning line;

an identification signal line driving circuit for supplying an identification signal to an identification signal line so disposed as to substantially cross said scanning line;

storage means for storing said identification signal supplied from said identification signal line in said pixel;

at least two gray scale voltage lines for supplying a gray scale voltage to each of said pixels;

a gray scale voltage line driving circuit for supplying said gray scale voltage to said at least two gray scale voltage lines;

selection means, disposed inside each of said pixels, for selecting said gray scale voltage supplied to said gray scale voltage lines on the basis of said identification signal stored in said storage means;

a switching device, disposed inside each of said pixels, for applying said selected gray scale voltage to said pixel electrode; and a gray scale write line driving circuit for supplying a gray scale write signal to a gray scale write line for controlling said switching device.

2. A display apparatus according to claim 1, wherein said display device comprises a light modulator using a liquid crystal; two said gray scale voltage lines are provided to one pixel; said storage means comprises a first active device connected to said identification signal line by use of said scanning line as a gate terminal and a pixel internal memory capacitance; said selection means comprises n and p type active devices having a gate terminal thereof connected to said memory internal capacitance, and connected to said two gray scale voltage lines, respectively; and said switching device comprises an n type active device and a p type active device using said gray scale write line as a gate terminal, and a fourth active device connected to said pixel electrode.

3. A display apparatus according to claim 2, wherein, in a first stage of display, said first active device connected to a selected scanning line becomes conductive, an identification signal is written into said pixel internal memory capacitance of each of said pixels, and said identification signal renders either one of said n and p type active devices conductive to thereby decide the voltage of either one of said two gray scale signal lines; and in a second stage of display, said gray scale write line is selected to thereby render said fourth active device conductive, the voltage of said gray scale signal line so decided is applied to said pixel electrode and changes the alignment of said liquid crystal, and light is modulated.

4. A display apparatus according to claim 2, wherein, in a first stage of display, said first active device connected to a selected scanning line becomes conductive, an identification signal is written into said pixel internal memory capacitance of each of said pixels, and said identification signal renders either one of said n and p type active devices conductive to thereby decide the voltage of either one of said two gray scale signal lines; and in a second stage of display, said gray scale write line is selected to thereby render said fourth active device conductive, the voltage of said gray scale signal line so decided is applied to said pixel electrode, and said fifth active device converts the voltage to a current and drives an LED.

5. A display apparatus according to claim 1, wherein two said gray scale voltage lines are disposed for one pixel; said storage means comprises a first active device connected to said identification signal line by use of said scanning line as a gate terminal, and a pixel internal memory capacitance; said selection means comprises an n type active device and a p type active device having a gate terminal thereof connected to said pixel internal memory capacitance, and connected to said two gray scale voltage lines, respectively; said switching device comprises n and p type active devices using said gray scale write line as a gate terminal, and a fourth active device connected to said pixel electrode; and said display device is an LED device driven by a fifth active device using said pixel electrode as a gate terminal.

6. A display apparatus comprising:

pixels arranged in matrix in a row direction and in a column direction;

a pixel electrode disposed inside each of said pixels;

a display device disposed inside each of said pixels, for executing display in accordance with a voltage of said pixel electrode;

a scanning line driving circuit for supplying a scanning signal to a scanning line;

an identification signal line driving circuit for supplying an identification signal to an identification signal line so disposed as to substantially cross said scanning line;

storage means for storing said identification signal supplied from said identification signal line in said pixel;

at least one gray scale voltage line for supplying a gray scale voltage to each of said pixels;

a gray scale voltage line driving circuit for supplying said gray scale voltage to said at least one gray scale voltage line;

selection means, disposed inside each of said pixels, for selecting said gray scale voltage supplied to said gray scale voltage lines of said pixel adjacent to each other or to said gray scale voltage line of own pixel on the basis of said identification signal stored in said storage means;

a switching device, disposed inside each of said pixels, for applying said selected gray scale voltage to said pixel electrode; and a gray scale write line driving circuit for supplying a gray scale write signal to a gray scale write line for controlling said switching device.

7. A display apparatus according to claim 6, wherein said display device comprises a light modulator using a liquid crystal; two said gray scale voltage lines are provided to one pixel; said storage means comprises a first active device connected to said identification signal line by use of said scanning line as a gate terminal and a pixel internal memory capacitance; said selection means comprises n and p type active devices having a gate terminal thereof connected to said pixel internal memory capacitance, and connected to said pixels adjacent to each other and to said two gray scale voltage lines of own pixel, respectively; and said switching device comprises an n type active device and a p type active device using said gray scale write line as a gate terminal, and a fourth active device connected to said pixel electrode.

8. A display apparatus according to claim 7, wherein, in a first stage of display, said first active device connected to a selected scanning line becomes conductive, an identification signal is written into said pixel internal memory capacitance of each of said pixels, and said identification signal renders either one of said n and p type active devices conductive to thereby decide the voltage of either one of said two gray scale signal lines inside said pixels adjacent to each other; and in a second stage of display, said gray scale write line is selected to thereby render said fourth active device conductive, the voltage of said gray scale signal line so decided is applied to said pixel electrode and changes the alignment of a liquid crystal, and light is modulated.

9. A display apparatus comprising:

pixels arranged in matrix in a row direction and in a column direction;

a pixel electrode disposed inside each of said pixels;

a display device disposed inside each of said pixels, for executing display in accordance with a voltage of said pixel electrode;

a scanning line driving circuit for supplying a scanning signal to a scanning line;

an identification signal line driving circuit for supplying an identification signal to an identification signal line so disposed as to substantially cross said scanning line;

storage means for storing said identification signal supplied from said identification signal line in said pixel;

a gray scale voltage line driving circuit for supplying a gray scale voltage to at least two gray scale voltage lines for supplying said gray scale voltage to each of said pixels;

selection means for selecting said gray scale voltage supplied to said gray scale voltage lines on the basis of said identification signal stored in said storage means;

a switch for outputting said selected gray scale voltage to said pixel electrode;

an area control line driving circuit for supplying an area control signal to an area control line for controlling said switch;

a switching device for applying said gray scale voltage outputted from said switch to said pixel electrode; and a gray scale write line driving circuit so disposed as to substantially cross said area control line, for supplying a gray scale write signal to a gray scale write line for controlling said switching device.

10. A display apparatus according to claim 9, wherein said display device comprises a light modulator using a liquid crystal; two said gray scale voltage lines are provided to one pixel; said storage means comprises a first active device connected to said identification signal line by use of said scanning line as a gate terminal and a pixel internal memory capacitance; said selection means comprises n and p type active devices having a gate terminal thereof connected to said pixel internal memory capacitance, and connected to said two gray scale voltage lines, respectively; said switch is an active device using said area control line as a gate terminal and connected to said n and p type active devices; and said switching device comprises a fourth active device using said gray scale write line as a gate terminal and connected to said active device and to said pixel electrode.

11. A display apparatus according to claim 10, wherein, in a first stage of display, said first active device connected to a selected scanning line becomes conductive, an identification signal is written into said pixel internal memory capacitance of each of said pixels, and said identification signal renders either one of said n and p type active devices conductive to thereby decide the voltage of either one of said two gray scale signal lines; and in a second stage of display, said area control line and said gray scale write line are selected to thereby render said active device and said fourth active device conductive, the voltage of said gray scale signal line is applied to said pixel electrode and changes the alignment of a liquid crystal in said pixel designated by said area control line and said gray scale write line, and light is modulated.

12. A display apparatus comprising:

pixels arranged in matrix in a row direction and in a column direction;

a pixel electrode disposed inside each of said pixels;

a display device disposed inside each of said pixels, for executing display in accordance with a voltage of said pixel electrode;

a scanning line driving circuit for supplying a scanning signal to a scanning line;

an identification signal line driving circuit for supplying an identification signal to an identification signal line so disposed as to substantially cross said scanning line;

storage means for storing said identification signal supplied from said identification signal line in said pixel;

at least one gray scale voltage line for supplying a gray scale voltage to each of said pixels;

a gray scale voltage line driving circuit for supplying said gray scale voltage to said at least one gray scale voltage line;

selection means, disposed inside each of said pixels, for selecting whether or not said gray scale voltage supplied to said gray scale voltage lines is to be outputted, on the basis of said identification signal stored in said storage means;

a switching device, disposed inside each of said pixels, for applying said gray scale voltage selected and outputted from said selection means to said pixel electrode;

a gray scale write line driving circuit for supplying a gray scale write signal to a gray scale write line for controlling said switching device; and a line memory for temporarily storing data to said identification signal line driving circuit and to said gray scale voltage line driving circuit.

13. A display apparatus according to claim 12, wherein said display device comprises a light modulator using a liquid crystal; one said gray scale voltage line is provided to one pixel; said storage means comprises a first active device connected to said identification signal line by use of said scanning line as a gate terminal and a pixel internal memory capacitance; said selection means comprises a second active device having a gate terminal thereof connected to said pixel internal memory capacitance, and connected to said gray scale voltage line; and said switching device comprises a fourth active device using said gray scale write line as a gate terminal, and connected to said second active device and to said pixel electrode.

14. A display apparatus according to claim 13, wherein, in a first stage of display, said first active device connected to a selected scanning line becomes conductive, and an identification signal for the first gray scale is written into said pixel internal memory capacitance of each of said pixels and controls the conduction state of said second active device to thereby decide whether or not the gray scale voltage is to be outputted; in a second stage of display, when said gray scale write line is selected, said fourth active device becomes conductive, the voltage of said gray scale signal line is applied to said pixel electrode in said pixel outputting the voltage for the first gray scale to thereby change the alignment of said liquid crystal, and light is modulated; in a third stage of display, said first active device connected to said scanning line once again selected becomes conductive, said identification signal for the second gray scale is written into said pixel internal memory capacitance of each of said pixels and controls the conduction state of said second active device to thereby decide whether or not said gray scale voltage is outputted; and in a fourth stage of display, when said gray scale write line is selected, said fourth active device becomes conductive, the voltage of said gray scale signal line is applied to said pixel outputting the voltage corresponding to the second gray scale to thereby change the alignment of said liquid crystal, and light is modulated; each of said display stages being repeated up to a 2n-th stage when n gray scales are defined for pixel blocks of N rows ×N' columns.

15. A display apparatus according to claim 13, wherein, when said pixel blocks consist of said pixels arranged in N rows×N' columns, the following process steps are conducted in blocks having a small gray scale change among a plurality of frames:

in a first stage of a first frame, said first active device connected to a selected scanning line becomes conductive, and an identification signal for the first gray scale is written into said pixel internal memory capacitance of each of said pixels and controls the conduction state of said second active device to thereby decide whether or not a gray scale voltage is to be outputted;

in a second stage, said fourth active device becomes conductive when said gray scale write line is selected, the voltage of said gray scale signal line is applied to said pixel electrode in said pixel outputting the voltage for the first gray scale to thereby change the alignment of said liquid crystal, and light is modulated;

in a third stage, said first active device connected to said scanning line again selected becomes conductive, and an identification signal for the second gray scale is applied to said pixel internal memory capacitance of each of said pixels and controls the conduction state of said second active device to thereby decide whether or not the gray scale voltage is to be outputted;

in a fourth stage, said fourth active device becomes conductive when said gray scale write is selected, the voltage of said gray scale signal line is applied to said pixel electrode in said pixel outputting the voltage of the second gray scale to thereby change the alignment of said liquid crystal, and light is modulated;

in a first stage of a second frame, said first active device connected to a selected scanning line becomes conductive and said identification signal for the third gray scale is written into said pixel internal memory capacitance of each of said pixels and controls the conduction state of said second active device to thereby decide whether or not the gray scale voltage is to be outputted;

in a second stage, said fourth active device becomes conductive when said gray scale write line is selected, and the voltage of said gray scale signal line is applied to said pixel electrodes in said pixel outputting the voltage for the third gray scale to thereby change the alignment of said liquid crystal, and light is modulated;

in a third stage, said first active device connected to said scanning line again selected becomes conductive, and an identification signal for a fourth gray scale is written into said pixel internal memory capacitance of each of said pixels and controls the conduction state of said second active device to thereby decide whether or not the gray scale voltage is to be outputted;

in a fourth stage, said fourth active device becomes conductive when said gray scale write line is selected, the voltage of said gray scale signal line is applied to said pixel electrode in said pixel outputting the voltage for the fourth gray scale and changes the alignment of said liquid crystal, and light is modulated; and when m gray scales are defined for pixel blocks of N rows×N' columns having a small gray scale change among a plurality of frames and said stages in one frame are m' stages, said process steps are repeated up to an m/(m'/2)-th frame;

whereas in pixel blocks having a large gray scale change among a plurality of frames, the following process steps are executed;

in a first stage of each of said frames, said first active device connected to a selected scanning line becomes conductive, said identification signal for the first gray scale is written into said pixel internal memory capacity of each of said pixels, and controls the conduction state of said second active device to thereby decide whether or not the gray scale voltage is to be outputted;

in a second stage, said fourth active device becomes conductive when said gray scale write line is selected, the voltage of said gray scale signal line is applied to said pixel electrode in said pixel outputting the voltage for the first gray scale to thereby change the alignment of said liquid crystal, and light is modulated;

in a third stage, said first active device connected to said scanning line again selected becomes conductive, said identification signal for the second gray scale is written into said pixel internal memory capacity of each of said pixels and controls the conduction state of said second active device to thereby decide whether or not the gray scale voltage is to be outputted; and in a fourth stage, said fourth active device becomes conductive when said gray scale write line is selected, and the voltage of said gray scale signal line is applied to said pixel electrode in said pixel outputting the voltage for the second gray scale to thereby change the alignment of said liquid crystal, and light is modulated; and when n gray scales are defined for pixel blocks of N rows×N' columns having a large gray scale change among a plurality of frames, said stages inside one frame are repeated up to a 2n-th stage, and each of said frames is repeated each time.

16. A display apparatus comprising:

pixels arranged in matrix in a row direction and in a column direction;

a pixel electrode disposed inside each of said pixels;

a display device disposed inside each of said pixels, for executing display in accordance with a voltage of said pixel electrode;

a scanning line driving circuit for supplying a scanning signal to a scanning line;

an identification signal line driving circuit for supplying an identification signal to an identification signal line so disposed as to substantially cross said scanning line;

storage means for storing said identification signal supplied from said identification signal line in said pixel;

at least one gray scale voltage line for supplying a gray scale voltage to each of said pixels;

a gray scale voltage line driving circuit for supplying said gray scale voltage to said at least one gray scale voltage line;

selection means, disposed inside each of said pixels, for selecting whether or not said gray scale voltage supplied to said gray scale voltage lines is to be outputted on the basis of said identification signal stored in said storage means; and a line memory for temporarily storing data to said identification signal line driving circuit and to said gray scale voltage line driving circuit.

17. A display apparatus according to claim 16, wherein said display device comprises a light modulator using a liquid crystal; one said gray scale voltage line is provided to one pixel; said storage means comprises a first active device connected to said identification signal line by use of said scanning line as a gate terminal and a pixel internal memory capacitance; and said selection means comprises a second active device having a gate terminal thereof connected to said pixel internal memory capacitance and connected to said gray scale voltage line.

18. A display apparatus according to claim 17, wherein, when said pixels are constituted into pixel blocks consisting of N rows×N' columns, the following process steps are conducted in blocks having a small gray scale change among a plurality of frames:

in a first stage of a first frame, said first active device connected to a selected scanning line becomes conductive, and an identification signal for the first gray scale is written into said pixel internal memory capacitance of each of said pixels;

in a second stage, said identification signal controls the conduction state of said second active device, the first gray scale voltage is outputted to said pixel electrode to thereby change the alignment of said liquid crystal, and light is modulated;

in a third stage, said scanning line is again selected, said first active device becomes conductive, and a reset signal applied to said identification signal line resets said pixel internal memory capacitance of each of said pixels;

in a fourth stage, said first active device connected to said scanning line again selected becomes conductive, and an identification signal for the second gray scale is applied to said pixel internal memory capacitance of each of said pixels;

in a fifth state, said identification signal controls the conductions state of said second active device, the second gray scale voltage is applied to said pixel electrode to thereby change the alignment of said liquid crystal and light is modulated; and in a sixth stage, said scanning line is again selected, said first active device becomes conductive and a reset signal applied to said identification signal line resets each of said pixel internal memory capacitance; and in a first stage of the second frame, said first active device connected to said scanning line selected becomes conductive, and an identification signal for the third gray scale is written into said pixel internal memory capacitance of each of said pixels;

in a second stage, said identification signal controls the conduction state of said second active device, the third gray scale voltage is outputted to said pixel electrode to thereby change the alignment of said liquid crystal, and light is modulated;

in a third stage, said scanning line is again selected, said first active device becomes conductive and a reset signal applied to said identification signal line resets each of said pixel internal memory capacitance;

in a fourth stage, said first active device connected to said scanning line again selected becomes conductive, and an identification signal for the fourth gray scale is written into each of said pixel internal memory capacitances;

in a fifth stage, said identification signal controls the conduction state of said second active device, the fourth gray scale voltage is outputted to said pixel electrode to thereby change the alignment of said liquid crystal and light is modulated; and in a sixth stage, said scanning line is selected further again, said first active device becomes conductive and a reset signal applied to said identification signal line resets each of said pixel internal memory capacitances; and when m gray scales are defined for pixel blocks of N rows×N' columns having a small gray scale change among a plurality of frames and said stages in one frame are m' stages, said process steps are repeated up to an m/(m'/3)-th frame;

whereas in a pixel block having a large gray scale change among a plurality of frames, the following process steps are executed;

in a first stage of each of said frames, said first active device connected to said scanning line selected becomes conductive, said identification signal for the first gray scale is written into said pixel internal memory capacitance of each of said pixels;

in a second stage, said identification signal controls the conduction state of said second active device, the first gray scale is outputted to said pixel electrode to thereby change the alignment of said liquid crystal, and light is modulated;

in a third stage, said scanning line is again selected, said first active device becomes conductive, a reset signal applied to said identification signal line resets each of said pixel internal memory capacitances;

in a fourth stage, said first active device connected to said scanning line again selected becomes conductive and an identification signal for the second gray scale is written into said pixel internal memory capacitance inside each of said pixels;

in a fifth stage, said identification signal controls the conduction state of said second active device, the second gray scale voltage is outputted to said pixel electrode to thereby change the alignment of said liquid crystal and light is modulated; and in a sixth stage, said scanning line is selected further again, said first active device becomes conductive and a reset signal applied to said identification signal line resets each of said pixel internal memory capacitances; and when n gray scales are defined for pixel blocks of N rows×N' columns having a large gray scale change among a plurality of frames, said stages inside one frame are repeated up to a 3n-th stage, and each of said frames is repeated each time.

19. A display apparatus according to claim 17, wherein, in a first stage of display, said first active device connected to a selected scanning line becomes conductive, and an identification signal for the first gray scale is written into said pixel internal memory capacitance of each of said pixels; in a second stage of display, said identification signal controls the conduction state of said second active device and the first gray scale voltage is outputted to said pixel electrode; in a third stage, said scanning line is again selected, said first active device connected to said scanning line again selected becomes conductive, and said pixel internal memory capacitance of each of said pixels is reset by a rest signal applied to said identification signal line; in a fourth stage of display, said first active device connected to said scanning line again selected becomes conductive and said identification signal for the second gray scale is written into said pixel internal memory capacitance of each of said pixels; in a fifth stage of display, said identification signal controls the conduction state of said second active device and the second gray scale voltage is outputted to said pixel electrode; and in a sixth stage of display, said scanning line is again selected, said first active device becomes conductive and the reset signal appiied to said identification signal line resets said pixel internal memory capacitance of each of said pixels; each of said display stages being repeated up to a 3n-th stage when n gray scales are defined for pixel blocks of N rows×N' columns.

* * * * *